US012264669B2

(12) United States Patent
Peterson et al.

(10) Patent No.: US 12,264,669 B2
(45) Date of Patent: Apr. 1, 2025

(54) SELF-PRIMING TRANSFER PUMP WITH QUICK PUMP ATTACHMENT/DETACHMENT

(71) Applicant: FARMCHEM CORP, Floyd, IA (US)

(72) Inventors: Justin Peterson, Floyd, IA (US); Ron Renkel, Floyd, IA (US); Ryan Bergman, Memphis, TN (US); Harley Thordson, Floyd, IA (US)

(73) Assignee: FARMCHEM CORP, Floyd, IA (US)

( * ) Notice: Subject to any disclaimer, the term of this patent is extended or adjusted under 35 U.S.C. 154(b) by 361 days.

(21) Appl. No.: 17/655,871

(22) Filed: Mar. 22, 2022

(65) Prior Publication Data

US 2022/0307517 A1 Sep. 29, 2022

Related U.S. Application Data

(60) Provisional application No. 63/200,719, filed on Mar. 24, 2021.

(51) Int. Cl.
*F04B 53/22* (2006.01)
*F04B 43/02* (2006.01)
*F04B 43/04* (2006.01)

(52) U.S. Cl.
CPC ..... *F04B 53/22* (2013.01); *F04B 43/026* (2013.01); *F04B 43/04* (2013.01)

(58) Field of Classification Search
CPC ..... F04B 43/02; F04B 43/021; F04B 43/025; F04B 43/026; F04B 43/04; F04B 51/00; F04B 53/16; F04B 53/22; Y10T 403/7041
(Continued)

(56) References Cited

U.S. PATENT DOCUMENTS 4,610,605 A 9/1986 Hartley
5,791,882 A * 8/1998 Stucker ..... F04B 43/0045 417/269

(Continued)

OTHER PUBLICATIONS

Author: Tapflow Title: New CAMLOCK connections for Metal series AODD pumps Date published (mm/yyyy): Nov. 2015 Date accessed (mm/dd/yyyy): Apr. 12, 2024 Link: https://tapflo.com/en/images/CAMLOCK_connections_for_Metal_series_AODD_pumps.pdf (Year: 2015).*

(Continued)

*Primary Examiner* — Kenneth J Hansen
*Assistant Examiner* — Chirag Jariwala
(74) *Attorney, Agent, or Firm* — McKee, Voorhees & Sease, PLC

(57) ABSTRACT

A self-priming transfer pump incudes fluid inlets and outlets that employ camlock fittings. The self-priming transfer pump also includes a unique motor plate and pump housing to allow a quarter-turn attachment after lining a splined motor shaft to a unique splined female mating portion. There exists a pump cartridge permanently affixed to the pump housing to eliminate user exposure and need for tools when replacing or changing out the pump. A quick connection and disconnection of pumping section from motor section requires no tools. An external locking mechanism prevents the pump section from rotating and disengaging from motor section. Multiple pump sections are usable with a single motor to prevent cross-contamination between products being pumped.

3 Claims, 30 Drawing Sheets

(58) Field of Classification Search
USPC ..... 417/413.1
See application file for complete search history.

(56) References Cited

U.S. PATENT DOCUMENTS

| | | | | |
|---|---|---|---|---|
| 5,806,161 | A * | 9/1998 | Schneider | B25B 27/14 29/271 |
| 6,715,994 | B2 | 4/2004 | Patel et al. | |
| 6,764,284 | B2 | 7/2004 | Oehman, Jr. | |
| 6,808,374 | B2 | 10/2004 | Phallen et al. | |
| 6,883,604 | B2 | 4/2005 | Mack et al. | |
| 7,137,794 | B2 * | 11/2006 | Pfetzer | F04D 29/628 417/423.14 |
| 7,284,965 | B2 | 10/2007 | Adahan | |
| 7,325,601 | B2 | 2/2008 | Mack et al. | |
| 7,780,406 | B2 | 8/2010 | Sloan et al. | |
| 7,857,607 | B2 | 12/2010 | Bishop et al. | |
| 7,918,654 | B2 | 4/2011 | Adahan | |
| 8,245,852 | B2 | 8/2012 | Sloan et al. | |
| 8,303,266 | B2 | 11/2012 | Rush et al. | |
| 8,449,267 | B2 | 5/2013 | Pascual et al. | |
| 8,585,372 | B2 | 11/2013 | Bacher et al. | |
| 8,616,862 | B2 | 12/2013 | Meza et al. | |
| 8,657,591 | B2 | 2/2014 | Hartmann et al. | |
| 9,115,486 | B2 | 8/2015 | Rakoczy et al. | |
| 9,546,663 | B2 | 1/2017 | Hoj et al. | |
| 9,664,199 | B2 | 5/2017 | Ripattila | |
| 9,719,502 | B2 * | 8/2017 | Wylie | F04B 53/16 |
| 9,962,663 | B2 | 5/2018 | Kimberlin et al. | |
| 9,970,429 | B2 | 5/2018 | Han et al. | |
| 10,047,737 | B2 * | 8/2018 | Meza | F04B 53/16 |
| 10,082,138 | B2 | 9/2018 | Han et al. | |
| 10,260,493 | B2 | 4/2019 | Kaufmann | |
| 10,309,394 | B1 | 6/2019 | Martin et al. | |
| 10,641,265 | B2 | 5/2020 | Kimball et al. | |
| 2005/0254972 | A1 | 11/2005 | Baker et al. | |
| 2007/0036643 | A1 | 2/2007 | Arnold | |
| 2007/0065316 | A1 | 3/2007 | Hanke et al. | |
| 2007/0237655 | A1 | 10/2007 | Baker et al. | |
| 2014/0161643 | A1 | 6/2014 | Weatherley | |
| 2015/0337820 | A1 * | 11/2015 | Cai | F04B 53/14 417/375 |
| 2016/0025086 | A1 * | 1/2016 | Meza | F04B 53/22 417/313 |
| 2019/0145387 | A1 * | 5/2019 | Schoenmeyr | F04B 43/026 417/269 |
| 2022/0178366 | A1 * | 6/2022 | Beaudry | F04B 39/14 |
| 2023/0003217 | A1 * | 1/2023 | Schöning | F04B 53/16 |

OTHER PUBLICATIONS

Author: Pump Supermarket Title: CAMLOCKS Fast Connections -Pumpsupermarket.com Date published (mm/dd/yyyy): Aug. 11, 2020 Date accessed (mm/dd/yyyy): Apr. 12, 2024 Link: https://www.youtube.com/watch?v=kMJx98eAAFg (Year: 2020).*

Diaphragm Pump, www.wikipedia.com, 2 pages, Mar. 6, 2021.

CT6 Diaphragm Pump—Installation Operation Maintenance Manual, Flowserve, pp. 1-24, Sep. 2020.

Models SF-1100, SF-1100-PTS, FM-1100 and FM100i—Installation, Operation, Repair and Parts Manual, Hypro, pp. 1-12, 2012.

* cited by examiner

SELF-PRIMING TRANSFER PUMP WITH QUICK PUMP ATTACHMENT/DETACHMENT

CROSS REFERENCE TO RELATED APPLICATIONS

This application claims priority under 35 U.S.C. § 119 to provisional patent application U.S. Ser. No. 63/200,719, filed Mar. 24, 2021. The provisional patent application is herein incorporated by reference in its entirety, including without limitation, the specification, claims, and abstract, as well as any figures, tables, appendices, or drawings thereof.

FIELD OF THE INVENTION

The invention relates generally to an apparatus and/or corresponding method of use in at least the energy industries. More particularly, but not exclusively, the invention relates to a self-priming transfer pump with a quick pump attachment/detachment.

BACKGROUND OF THE INVENTION

The background description provided herein gives context for the present disclosure. Work of the presently named inventors, as well as aspects of the description that may not otherwise qualify as prior art at the time of filing, are neither expressly nor impliedly admitted as prior art.

A diaphragm pump, also known as a membrane pump, is a positive displacement pump that uses a combination of the reciprocating action of a rubber, thermoplastic or polytetrafluoroethylene (e.g., Teflon®) diaphragm and suitable valves on either side of the diaphragm (check valve, butterfly valves, flap valves, or any other form of shut-off valves) to pump a fluid.

Three types of diaphragm pumps are known in the art: (1) diaphragm pumps where the diaphragm is sealed with one side in the fluid to be pumped, the other side is sealed in air or hydraulic fluid, and the diaphragm is flexed, causing the volume of the pump chamber to increase and decrease; in these diaphragm pairs, often there exists a pair of non-return check valves prevent reverse flow of the fluid; (2) diaphragm pumps employing volumetric positive displacement where the prime mover of the diaphragm is electro-mechanical, working through a crank or geared motor drive, or purely mechanical, such as with a lever or handle; and (3) diaphragm pumps employing one or more unsealed diaphragms with the fluid to be pumped on both sides wherein the diaphragm(s) are flexed, causing the volume to change.

When the volume of a chamber of either type of pump is increased and the diaphragm moves up, the pressure decreases, and fluid is drawn into the chamber. When the chamber pressure later increases from decreased volume and the diaphragm moves down, the fluid previously drawn in is forced out. When the diaphragm is again allowed to move up, fluid is once again drawn into the chamber, and a cycle of reciprocating motion is thus created. The reciprocating motion is similar to that of the cylinder in an internal combustion engine of an aircraft.

Diaphragm pumps generally have good suction lift characteristics, such as those with low pressure pumps and low flow rates. Other diaphragm pumps are capable of higher flow rates, such as those employing more specific/effective working diameters and stroke lengths, and can handle sludges and slurries with a relatively high amount of grit and solid content.

Known pumps in the art require bolts to hold the pump to the motor and the pumping 'guts' are not permanently affixed to the pump housing. Still others include different mechanical fasteners that require undue time and burden to remove a pump section for replacement, repair, and/or inspection.

Thus, there exists a need in the art for an apparatus which allows end users to remove a pump and replace it without use of any tools or exposure to the product that was pumped.

SUMMARY OF THE INVENTION

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the invention to improve on or overcome the deficiencies in the art.

It is a further object, feature, and/or advantage of the invention to prevent cross-contamination between products being pumped and/or to design the self-priming transfer pump so as to separate pump fluids from sensitive internal pump parts (the 'guts' of the pump). For example, multiple pump sections can be used use with a single motor.

It is still yet a further object, feature, and/or advantage of the invention to hermetically seal the drive mechanism and the compression chamber to one another, allowing the pump to transfer, compress, and evacuate the medium without a lubricant. For example, an elastomeric diaphragm can be used as a versatile dynamic seal that does not leak, offers little friction, and is constructed for low pressure sensitivity. Depending on the application for the pump, suitable material(s) for the diaphragms can be chosen to provide a seal that is effective over a wide range of pressures and temperatures without needing lubrication or maintenance.

It is preferred the self-priming transfer pump be safe, cost effective, and durable. In a preferred embodiment, there will thus exist a pump cartridge permanently attached to the pump housing to eliminate user exposure to hazardous chemicals and the need for tools when replacing or changing out the pump. For example, surface(s) of the self-priming transfer pump can be insulated and/or otherwise adapted to resist thermal transfer and/or electric conductivity. Furthermore: internal pump parts can operate within oil, suspended and isolated, to promote pump longevity; the self-priming transfer pump can be designed to mitigate and/or pump highly viscous, abrasive, corrosive, toxic, and/or flammable solutions; the self-priming transfer pump can operate with fluid in the casing; and the self-priming transfer pump can be adapted such that it can safely operate even with parameters that are in excess of standard operating parameters for a diaphragm pump, characterized as follows: flows of 18 (eighteen) gallons per minute (gpm), liquid pressures of 30 (thirty) pounds per square inch (psi); liquid temperatures up to 150 (one-hundred fifty) degrees Fahrenheit (° F.); an operating current of 20 (twenty) amperes (A); and dead head current of 29 (twenty-nine) amperes (A).

The self-priming transfer pump disclosed herein can be used in a wide variety of pumping applications which are not limited to use of a diaphragm in the pump.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the invention.

Methods can be practiced which facilitate use, manufacture, assembly, maintenance, and repair of a self-priming transfer pump which accomplishes some or all of the previously stated objectives. For example, maintenance of the pump can include avoiding operation of the pump above liquid freezing points.

The self-priming transfer pump can be incorporated into fluid systems which accomplish some or all of the previously stated objectives. For example, wherever there exists a need to transfer chemical product(s), said transfer can be enhanced by employing a self-priming transfer pump according to one or more of aspects of the invention described herein.

The self-priming pump can be also incorporated into systems kits which include one or more components of the self-priming pump described above and/or complementary components. For example, such kits can include an electronic flow meter along with a diaphragm pump. Such kits may also include, but are not limited to: hoses, recirculation piping, various fittings and adapters, brackets, dispensing nozzles, and dip-tubes.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the invention can be practiced are illustrated and described in detail, wherein like reference characters represent like components throughout the several views. The drawings are presented for exemplary purposes and may not be to scale unless otherwise indicated.

FIGS. 19A-C show three distinct positions of securement throughout the rotational movement amongst the aforementioned components, and FIG. 20 shows how to engage the external locking mechanism to further prevent unintended rotational movement amongst the aforementioned components and/or excessive vibration of the self-priming transfer pump during operation.

Figure 1:
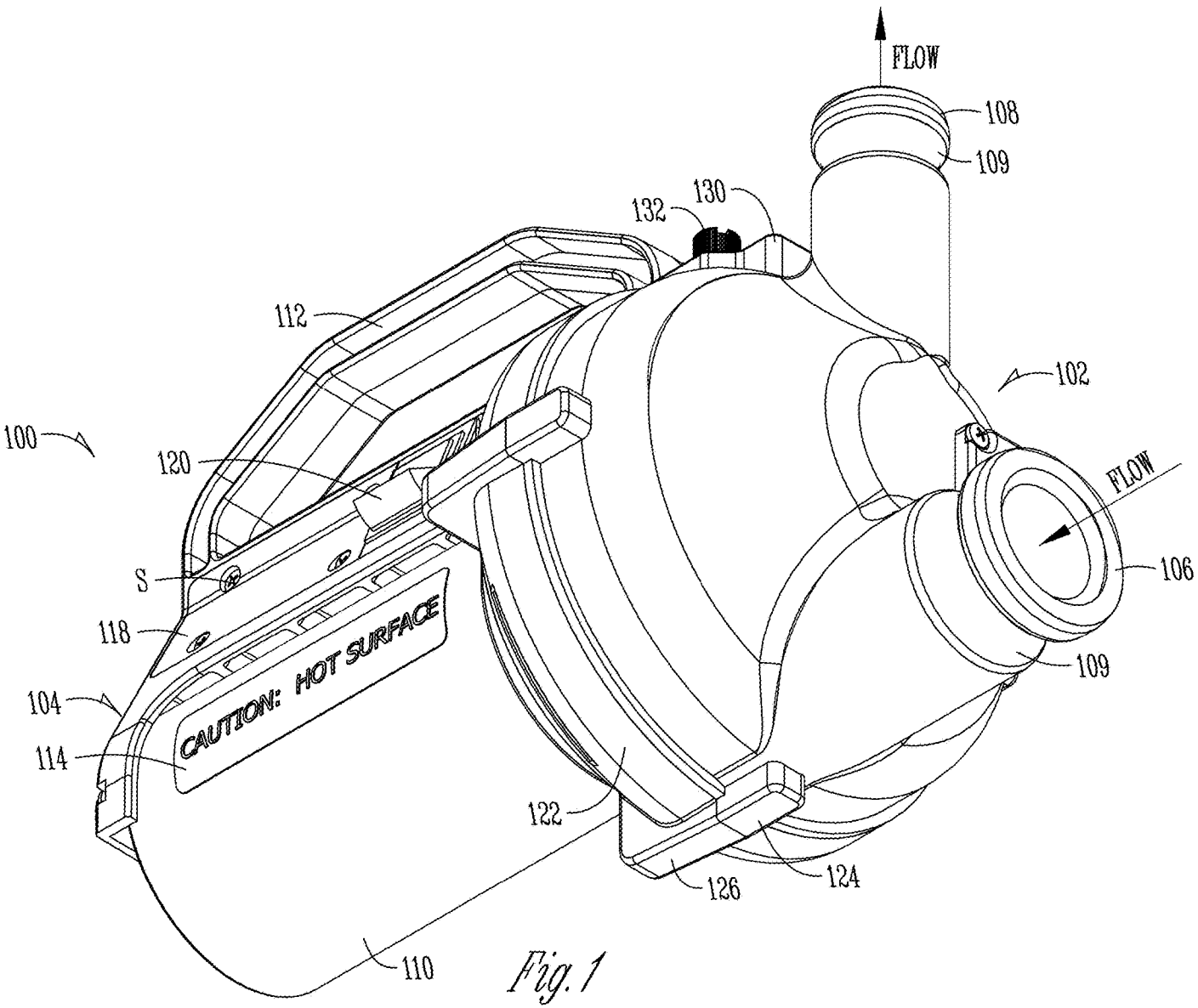
FIG. 1 shows a perspective view of a self-priming transfer pump with quick pump attachment/detachment, according to some aspects of the invention.
Figure 2:
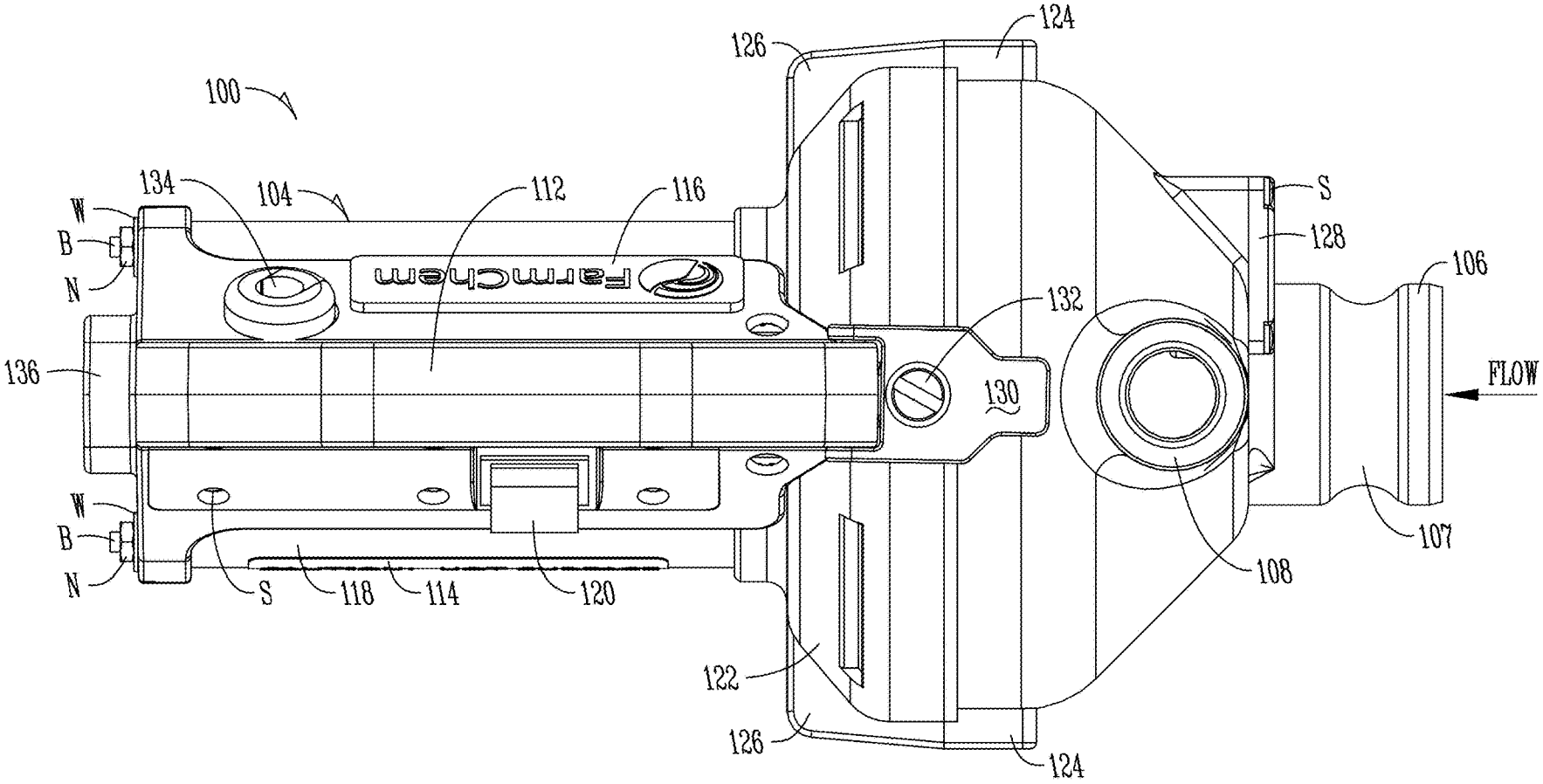
FIG. 2 shows a top elevational view of the self-priming transfer pump of FIG. 1.

An artisan of ordinary skill need not view, within isolated figure(s), the near infinite number of distinct permutations of features described in the following detailed description to facilitate an understanding of the invention.

DETAILED DESCRIPTION OF THE INVENTION

The present disclosure is not to be limited to that described herein. Mechanical, electrical, chemical, procedural, and/or other changes can be made without departing from the spirit and scope of the invention. No features shown or described are essential to permit basic operation of the invention unless otherwise indicated.

Referring now to the figures, FIGS. 1-7 show various external views of an improved self-priming transfer pump 100 (hereinafter "pump 100"). The pump 100 is referred to as a self-priming transfer pump such because the pump is able to transfer chemical product(s) while operating, and can operate even where air is mixed with said chemical product(s).

The pump 100 includes a pump section 102 and a motor section 104. The pump section acts as the main pump housing and includes an inlet 106 and outlet 108. Chemical product(s) enter the pump section 102 by way of an inlet 106 and exit by way of an outlet 108, thereby causing their transfer from locations positioned fluidly upstream of said inlet 106 to locations positioned fluidly downstream of said outlet 108. Examples of upstream locations of the pump include drums, intermediate bulk containers and mini bulk systems, as well as other containers. Typical direction of fluid flow is represented by the arrows shown in FIG. 1, though it is to be appreciated there can exist embodiments where the pump 100 is a reversible pump and/or two-way fluid flow is permitted.

A portion of the pump section 102 comprising the inlet 106 can include a radially recessed groove 107 and another portion of the pump section 102 comprising the outlet 108 can includes a radially recessed groove 109 for receiving a cam of a camlock fitting (not shown), also known as a cam and groove coupling. The cam and groove coupling is a reliable means of connecting and disconnecting hoses quickly and without tools. In function, the cams at the end of each lever of the camlock fitting on the female end align with a circumferential groove 107, 109 on the male end. When the levers are rotated to the locked position, they pull the male end into the female socket, creating a tight seal against a gasket within the female socket. The arms lock into position using over-center geometry, preventing accidental decoupling. Further, lever safety pins are common features for additional security, and female-end "self-locking" levers can also be used. Because the groove 107, 109 is cut all the way around the male end, there no specific rotational alignment is required to couple, as there would be with threaded connectors, and there is no opportunity for cross-threading. This results in a fast, error-resistant coupling operation. Because the compression between the two fittings is limited by the size of the cams on the end of the levers and the rotation of the levers themselves, there is also no possibility of over- or under-tightening the fitting; the pressure against the sealing gasket is effectively constant from one coupling operation to the next, reducing possibility of leaks. Cam and groove fittings are commonly available in several materials, including stainless steel, aluminum, brass, and polypropylene.

The primary purpose of the motor section 104 is to house pump motor 110 and to allow said pump motor 110 to interface with the pump section 102. The pump motor 110 can be a standard 12-volt motor engineered to produce flow rate up to 13 gallons per minute (gpm) at 70 (seventy) degrees Fahrenheit (° F.) with a 30 (thirty) minute duty cycle.

Inclusion of a lightweight frame and/or the handle 112 can make the pump 100 highly portable. For application flexibility, the pump 100 may be vertically mounted, horizontally mounted, or otherwise mounted in any orientation or fixed position.

It is thus to be appreciated that there exists alternative embodiments wherein the pump motor 110 is a heavy duty motor, such as a 115V motor. Use of such a motor may still be implemented with advantages of portability, though at a certain point handheld portability may no longer be possible due to the increased weight of the pump motor 110. In said embodiments, the handle 112 may be omitted, the pump motor 110 may require a grounded connection (e.g., to a ground-fault circuit interrupter ("GFCI") outlet), the housing for the pump motor 110 can comprise a cage, and if portability is still desired, wheels and/or other means for easy transport of heavier objects can be provided.

For purposes of durability, the pump 100 is preferably chemically resistant. Polypropylene pump housings and peroxide-cured EPDM valves and seals can be included. Optionally, thermoplastic vulcanizers can be used in valves with thermoplastic vulcanizer (e.g., Santoprene™) and/or fluorocarbon-based fluoroelastomer (e.g., Viton™) seal configurations. Moreover, it is to be appreciated safe operation of the pump 100 should always be a top priority. Caution labels 114 and/or other instructions can be placed on the motor section 104. Similarly, to even further protect operators of the pump 100, indicators 116 indicating source of origin assure operators quality standards typical to the source of origin have first been met, and prior to operation, as exemplified in FIG. 2. Alternatively, it is to be appreciated that instead of indicators 116 indicating source of origin, statements of compliance with certain applicable regulatory standards can be used in lieu thereof.

A motor cover 118 can allow/prevent access to internal components of the pump motor 110. The motor cover 118 and/or integrated lower housing of the pump motor 110 can include a built-in rocker switch 120 to turn the pump 100 on/off.

Figure 3:
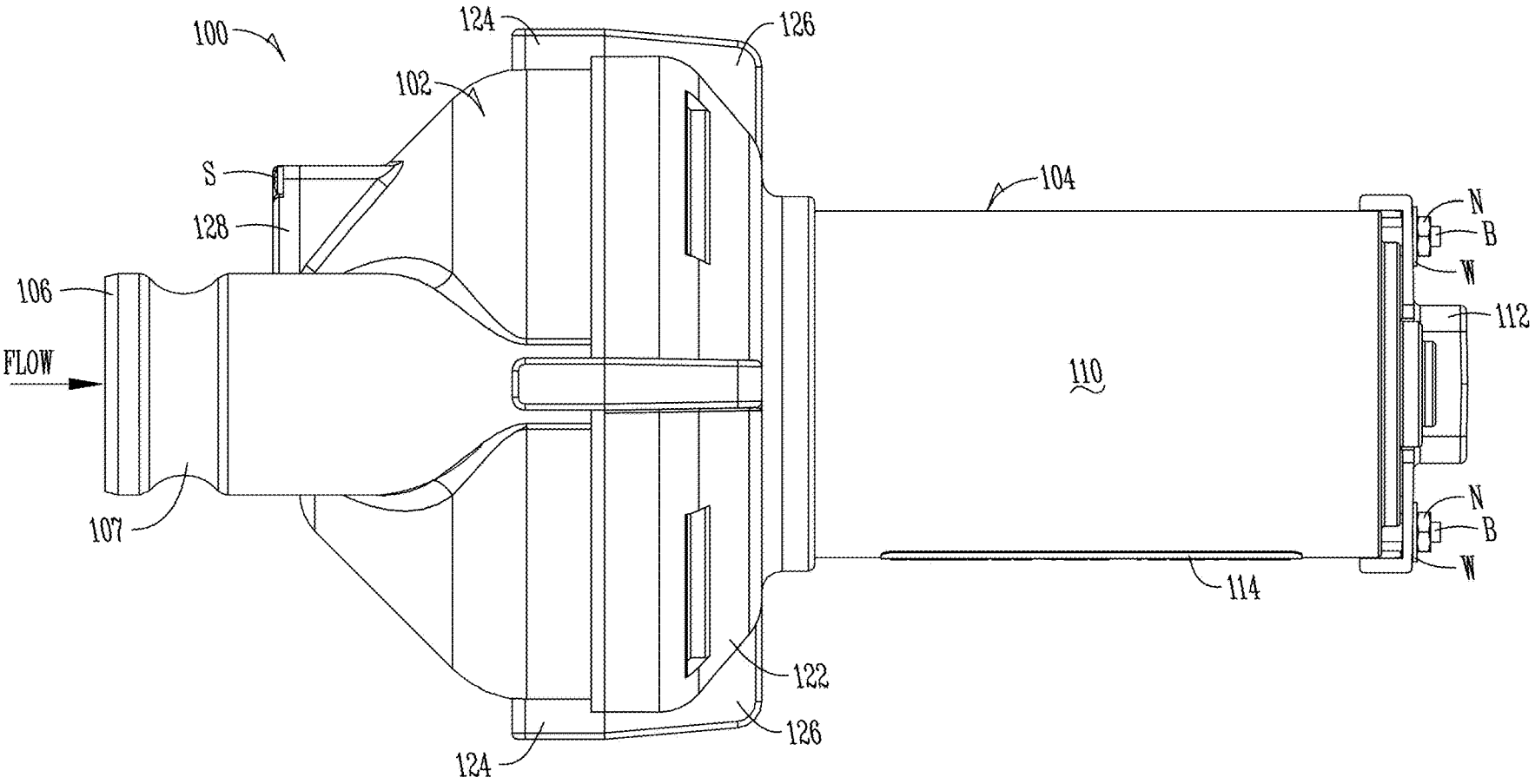
FIG. 3 shows a bottom elevational view of the self-priming transfer pump of FIG. 1.

Referring to the handheld portable version of the pump 100 with handle 112, a major advantage described in the present disclosure is a unique configuration of the motor mounting plate 122 of the motor section 104, especially with regard to how the motor mounting plate 122 connects to the pump section 102. For example, corresponding, reinforcing brackets 124, 126 can be included and/or symmetrically arrayed on the pump section 102 and motor section 104, respectively. As shown in FIG. 3, the corresponding, reinforcing brackets 124, 126 have additional utility to the operator in that they can suggest an operating position for the pump 100, i.e. that the brackets should line up during same, though such a feature is not necessarily required.

Figure 4:
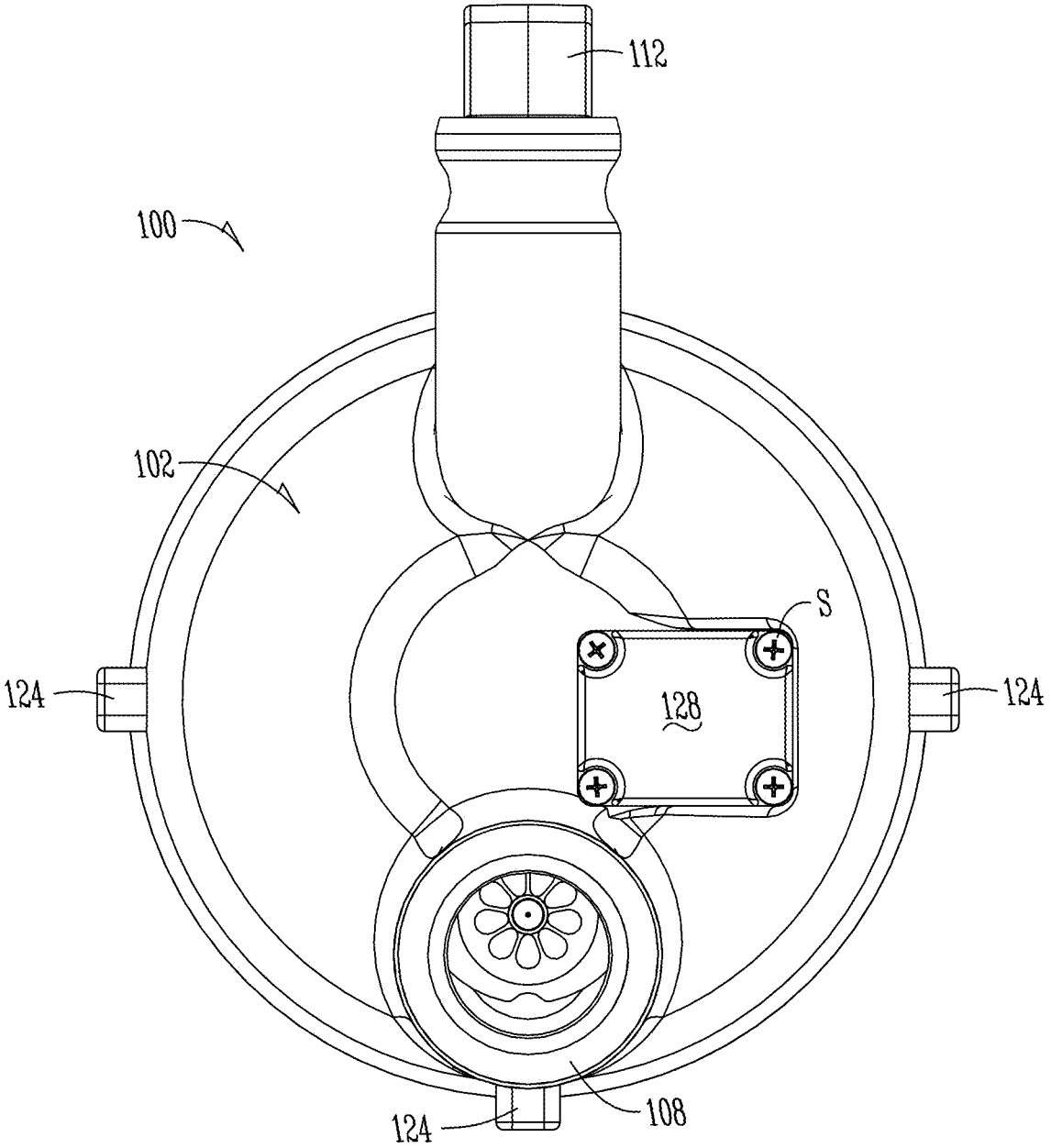
FIG. 4 shows a front elevational view of the self-priming transfer pump of FIG. 1.
Figure 5:
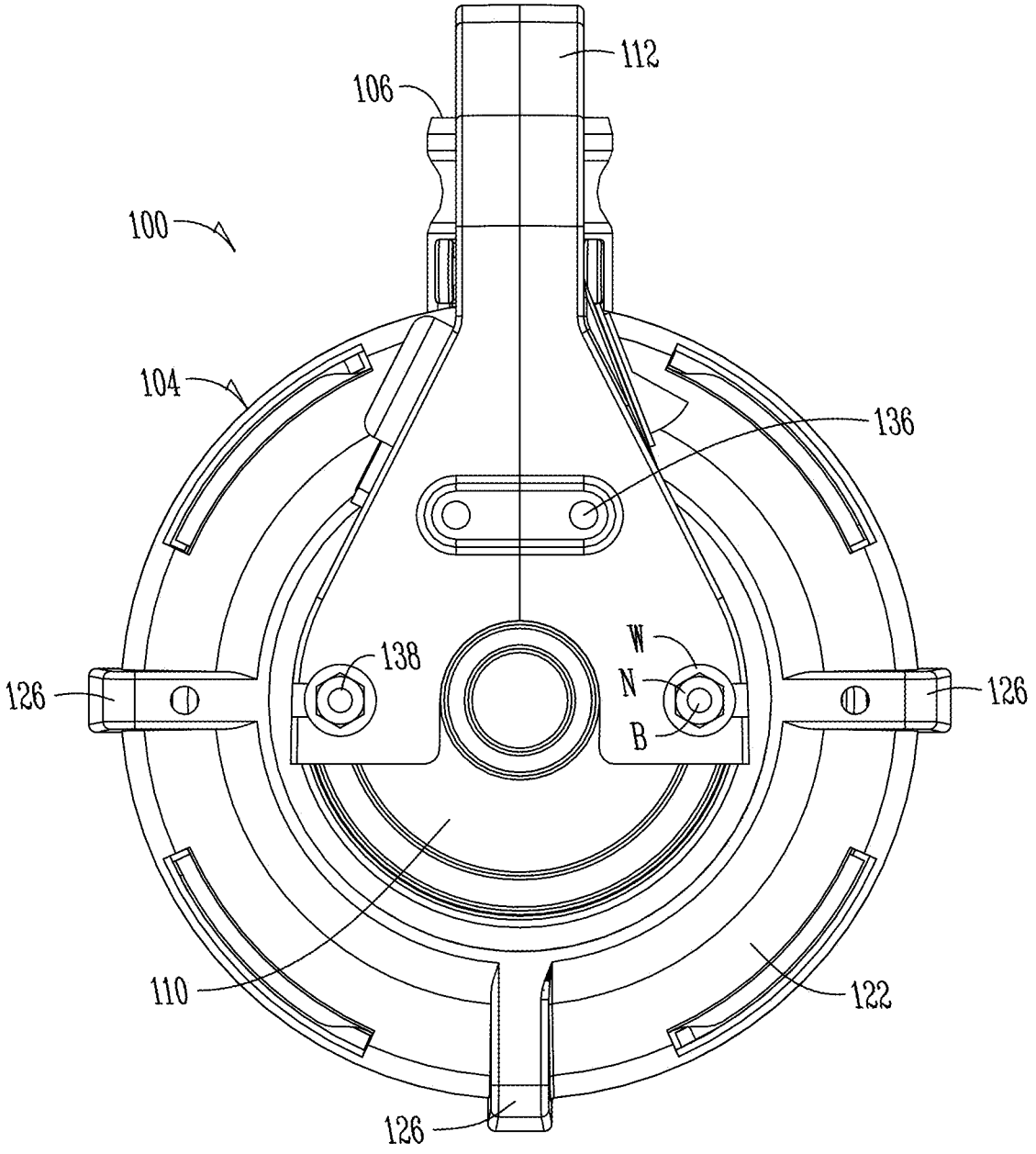
FIG. 5 shows a rear elevational view of the self-priming transfer pump of FIG. 1.

The relief valve cover 128 of the pump section 102 is perhaps best shown in FIG. 4, which allows the operator of the pump 100 to access to a relief valve (described in more detail with reference to FIG. 9). There may exist some embodiments where no relief valve cover 128 is provided and the entire pump section 102 must be replaced to the extent there are issues with said relief valve. If, however, such access is permitted but irregular, it should be appreciated the use of screws S or other fasteners removable only with the use of tools can be preferred. The same goes for other irregularly removable parts of the pump section 102 and motor section 104, such as the handle 112, can be mounted via removable nuts N and washers W, as is exemplified in FIG. 5.

Figure 6:
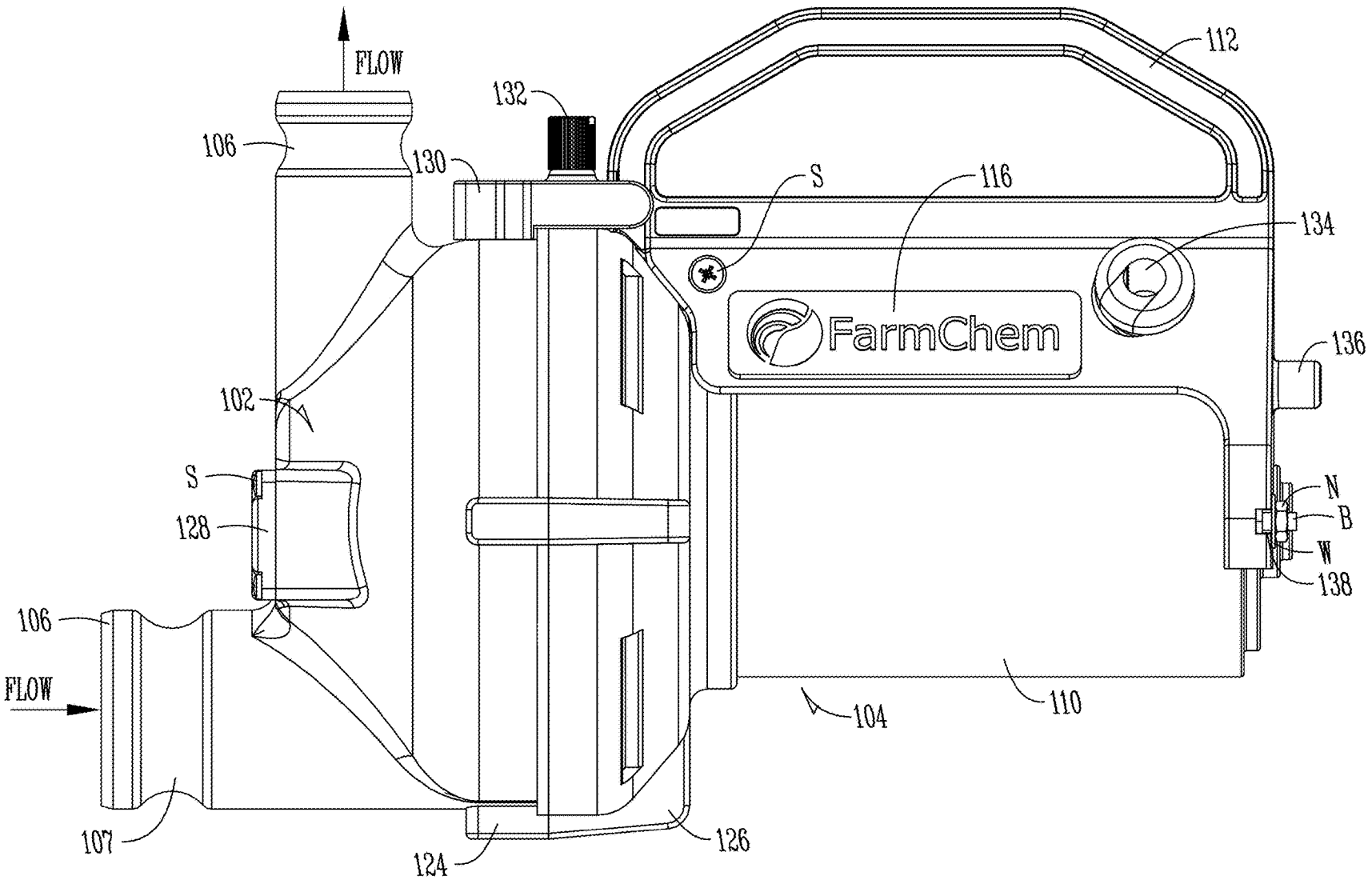
FIG. 6 shows a right-side elevational view of the self-priming transfer pump of FIG. 1.
Figure 7:
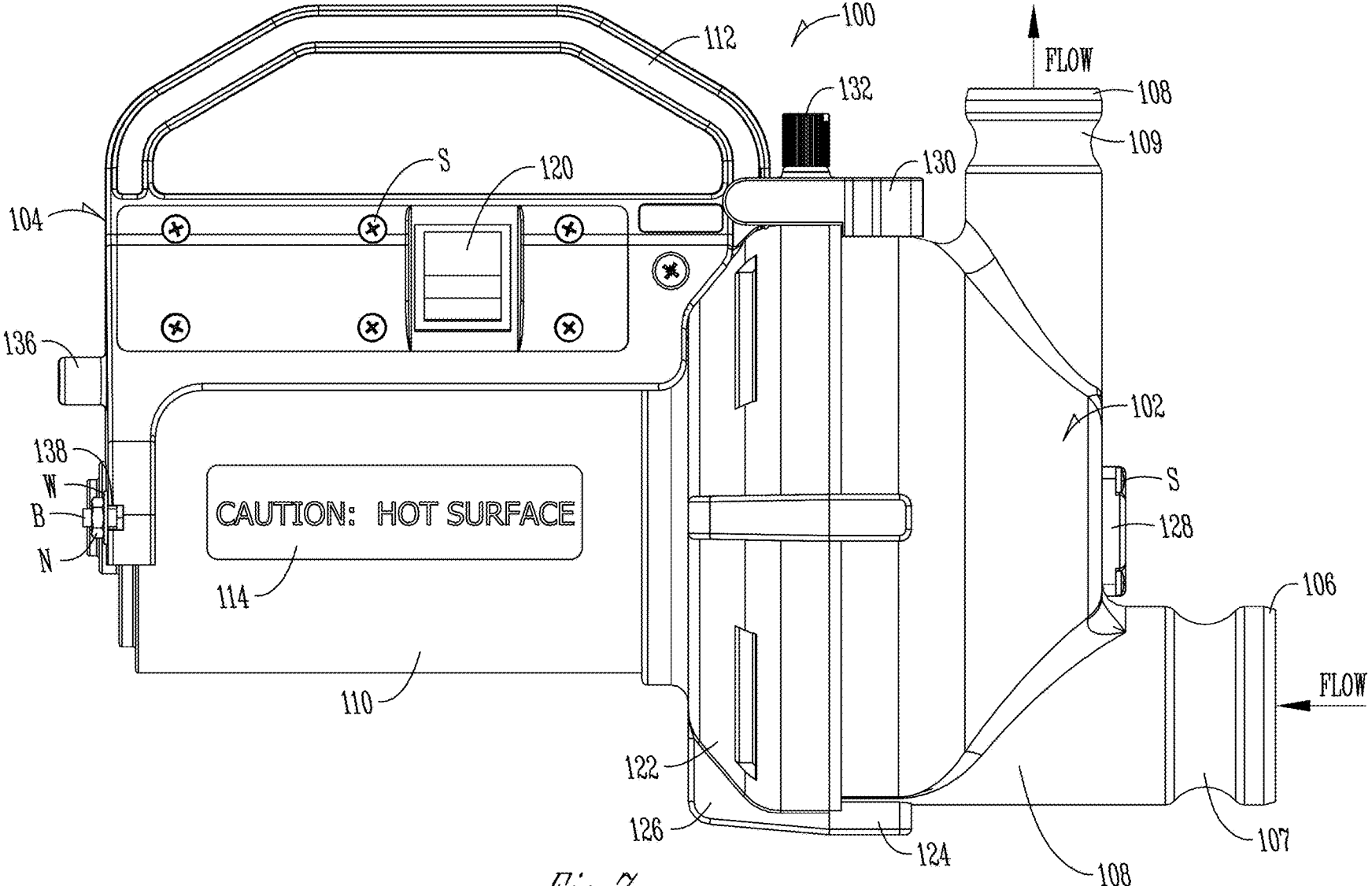
FIG. 7 shows a left-side elevational view of the self-priming transfer pump of FIG. 1.

Turning now to FIGS. 6-7, the connection between the pump section 102 and motor section 104, and in even greater particularity, the locking mechanism 130 and head screw 132 (e.g., the knurled panel screw toward the upper portion of the page, a star knob, a thumb screw, or the like) are prominently shown. FIG. 6 in particular also shows a snap in cord grip 134, which can allow for cords and/or other external power supplies the ability to supply power to the pump motor 110. FIG. 7 in particular features points of connection 136, 138 through which the handle 112 can mount to the pump motor 110; the use of multiple points of connection 136, 138 in distinct locations allows for increased stability between the handle 112 and the pump motor 110.

Where screws S, bolts B, nuts N, and washers W, are shown and/or described with reference to FIGS. 1-18, it should be appreciated there may be other fasteners outside of those shown that can be, or are even preferred over, be substituted for shown fasteners, provided the intended application of the pump 100 so allows. These other fasteners can include screws, nuts, bolts, pins, rivets, staples, washers, grommets, latches (including pawls), ratchets, clamps, clasps, flanges, notches, ties, adhesives, welds, or combination(s) thereof. In other words, nothing in this disclosure should be taken to preclude the use of different, more, or less fasteners than that which is shown in the figures. In some figures, such as FIG. 8, at least some of the fasteners have even been hidden so as to emphasize other components discussed with reference to that particular figure.

Figure 8:
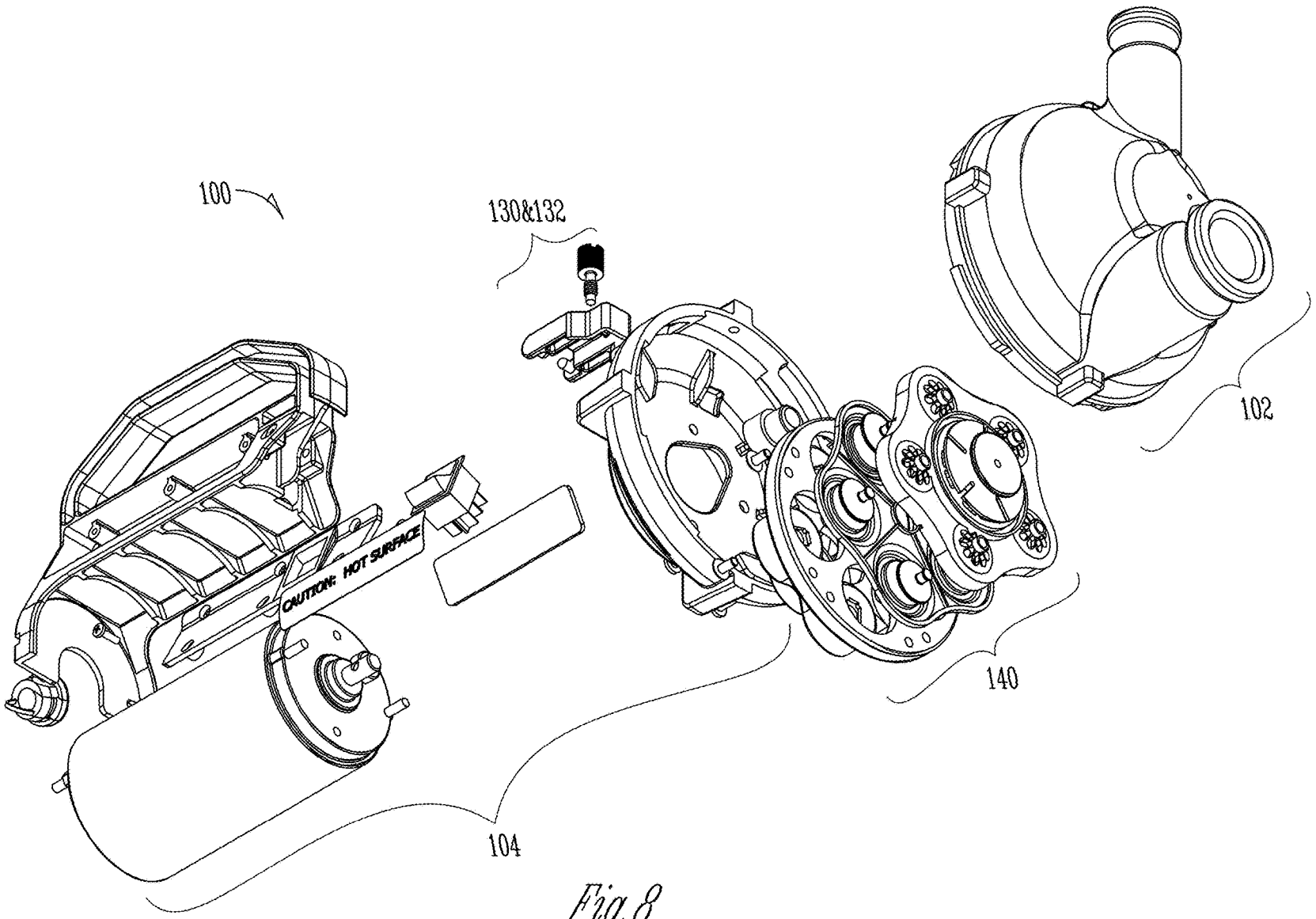
FIG. 8 shows an exploded view of the self-priming transfer pump of FIG. 1.

FIG. 8, in particular emphasizes order of the internal components of the pump 100, also known as the 'guts' 140. Some of the guts 140 will reside in the pump section 102 during operation, while others will reside in the motor section 104. In some embodiments, some guts 140 can reside in the pump section 102 (e.g., where the pump section 102 has a longer housing), while in other embodiments, the guts 140 can reside in the motor section 104 (e.g., where the motor section 104 has a longer housing). Moreover, this disclosures envisions embodiments where the pump section 102 is provided to the operator as a completed assembly not intended to be assembled/disassembled by the pump operator. In said embodiments, some of the components that can reside, but are not limited to residing, directly beneath the housing of the motor section 104 during operation are permanently attached to the pump section 102 and are only temporarily attached to the motor section 104. Such configurations have many advantages, and include at least: ease of assembly, ease of replaceability/interchangeability of the guts 140, and increased safety of the operator.

FIGS. 9-16 show a diaphragm-type drive assembly in an operable position, according to some aspects of the present disclosure. The diaphragm-type drive assembly can be a wobble-plate type assembly or any other suitable type of drive assembly. Although the diaphragm-type assembly shown includes five fluid chambers, any number of chambers can be employed to accomplish the objectives set forth herein.

FIGS. 9-13 show various partially hidden views of the pump 100 from a front, pump-side perspective. While several of the guts 140 of the pump 100 are shown against the housing of the motor section 104 throughout FIGS. 9-13, it is to be appreciated that in a preferred embodiment, the guts 140 do not connect permanently to the motor 110, but are actually permanently attached to the housing of the pump section 102.

Figure 14:
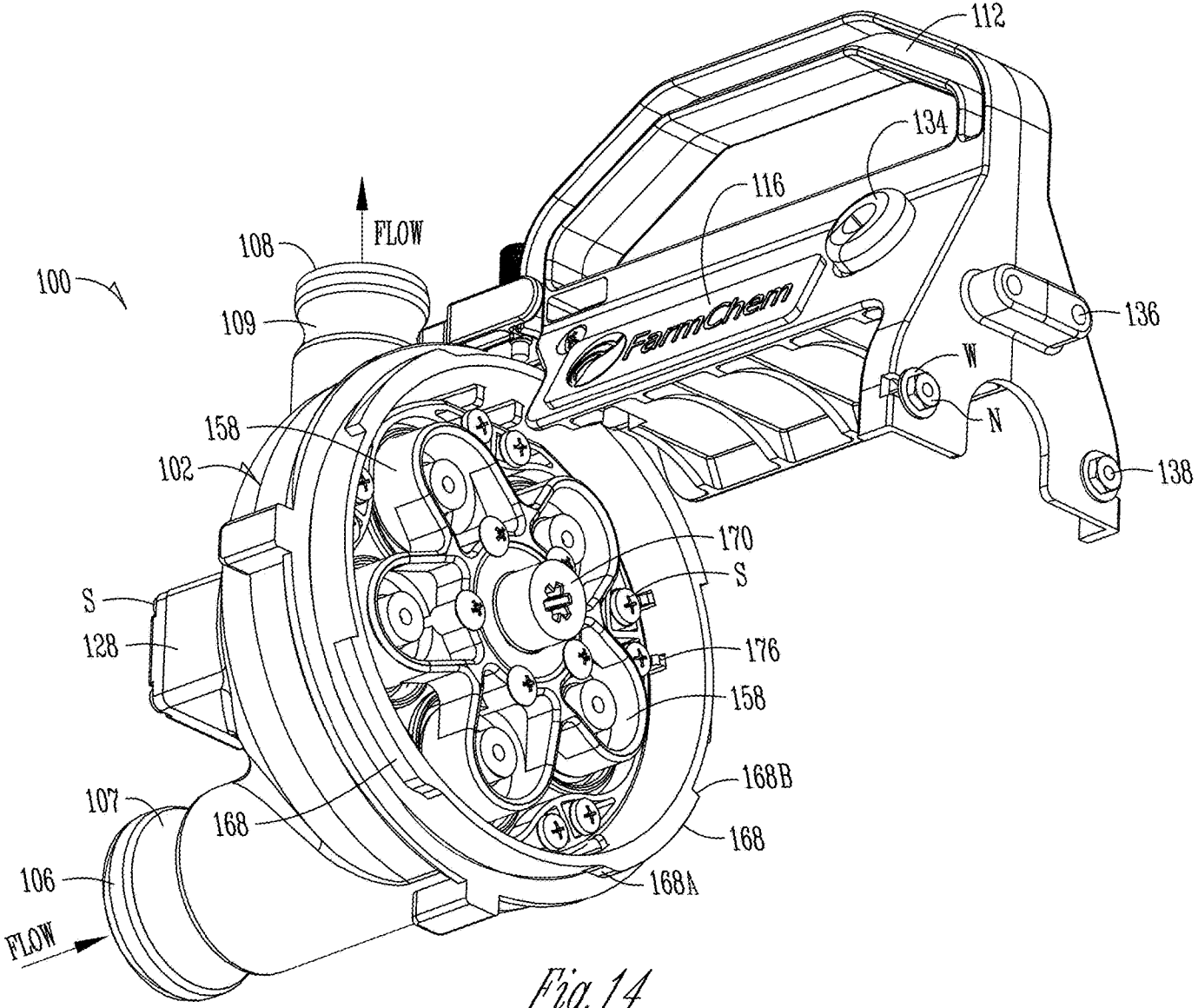
FIG. 14 shows a partially hidden, rear perspective view of the self-priming transfer pump of FIG. 8 wherein the motor section, except for the handle and components related thereto, hidden from view, thereby emphasizing view of wobble plate and other components related thereto.
Figure 15:
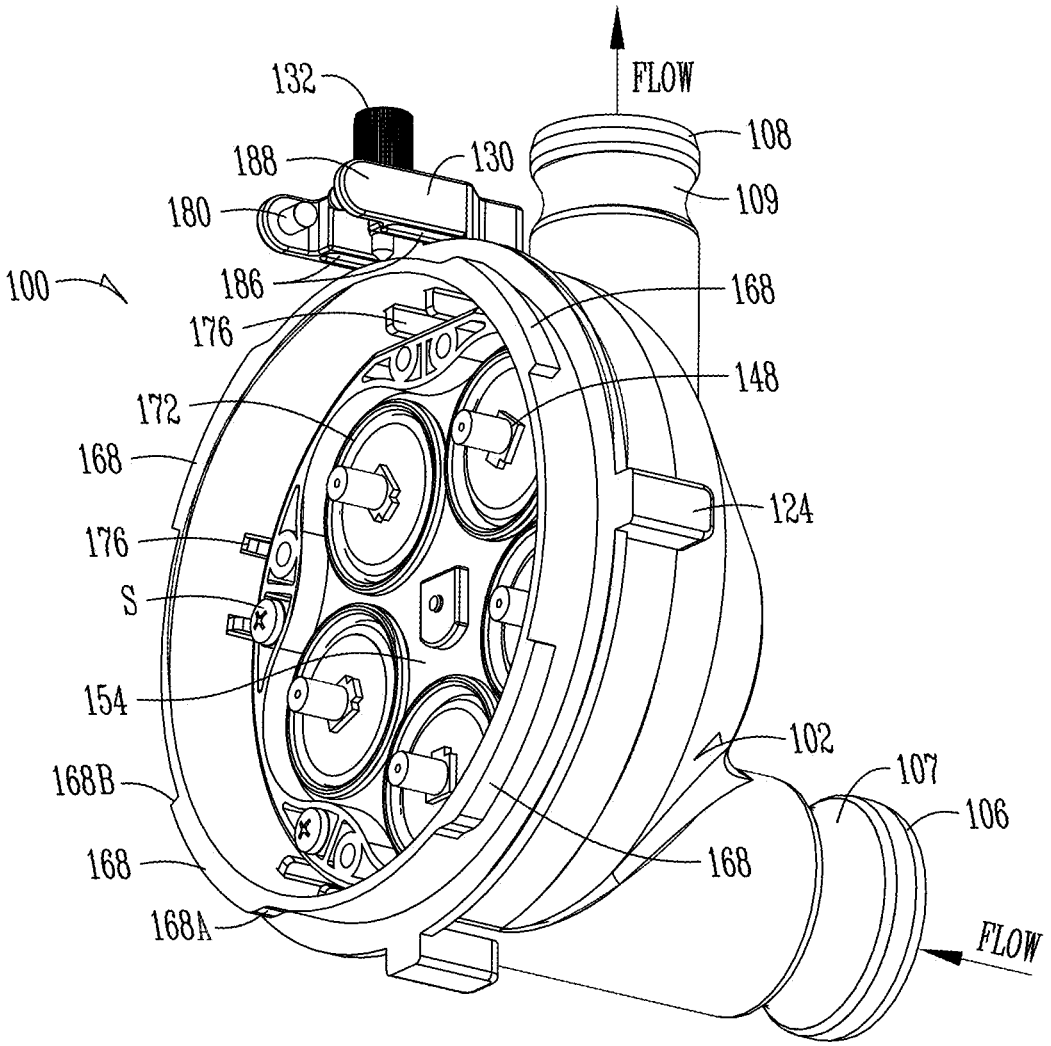
FIG. 15 shows a partially hidden, rear perspective view of the self-priming transfer pump of FIG. 14 wherein the wobble plate is further hidden from view, thereby emphasizing view of the clamp plate and other components related thereto.
Figure 16:
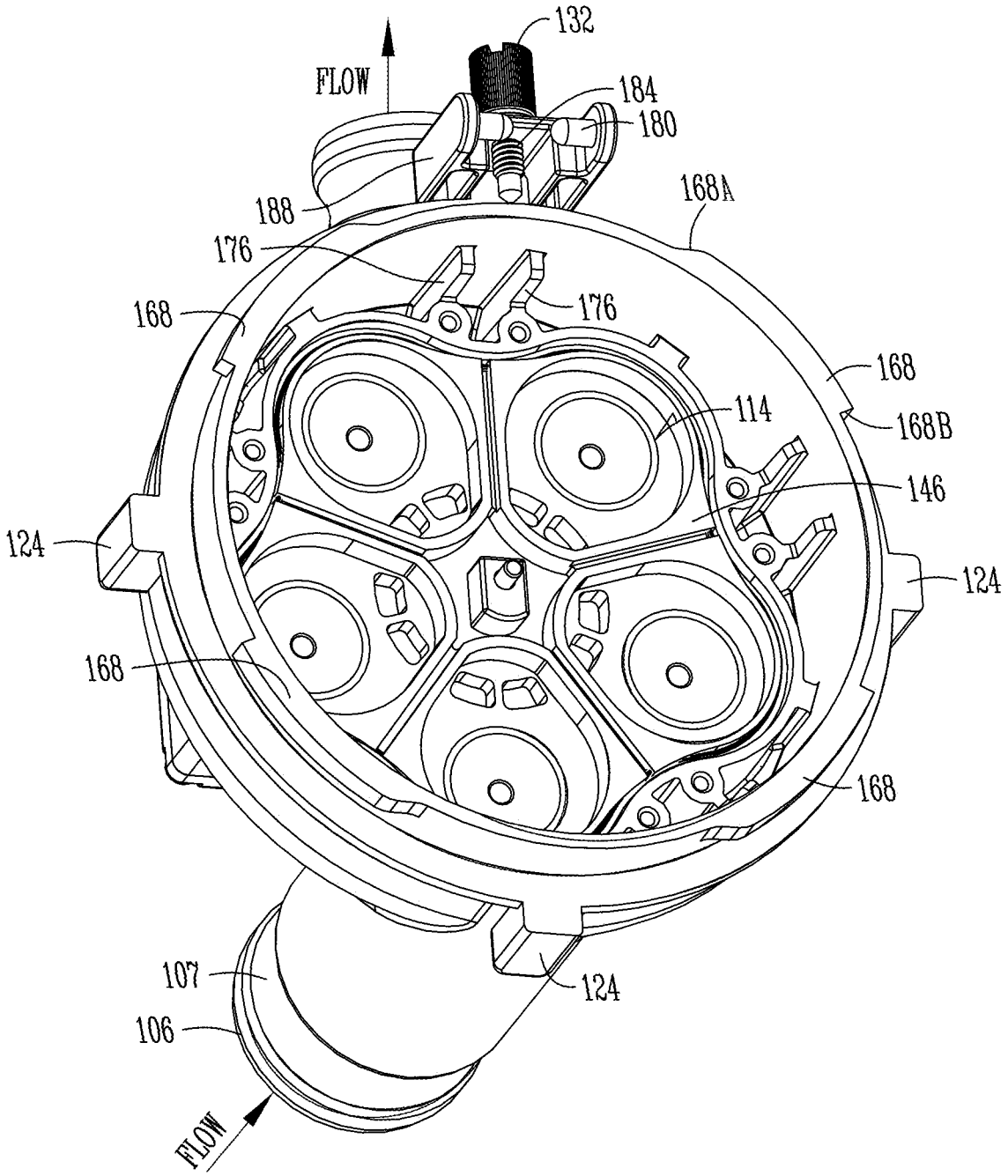
FIG. 16 shows a partially hidden, rear perspective view of the self-priming transfer pump of FIG. 15 wherein the clamp plate and diaphragm are further hidden from view, thereby emphasizing view of the valve plate and other component(s) related thereto.

FIGS. 14-16 show various partially hidden views of the pump 100 from a front, pump-side perspective.

Figure 9:
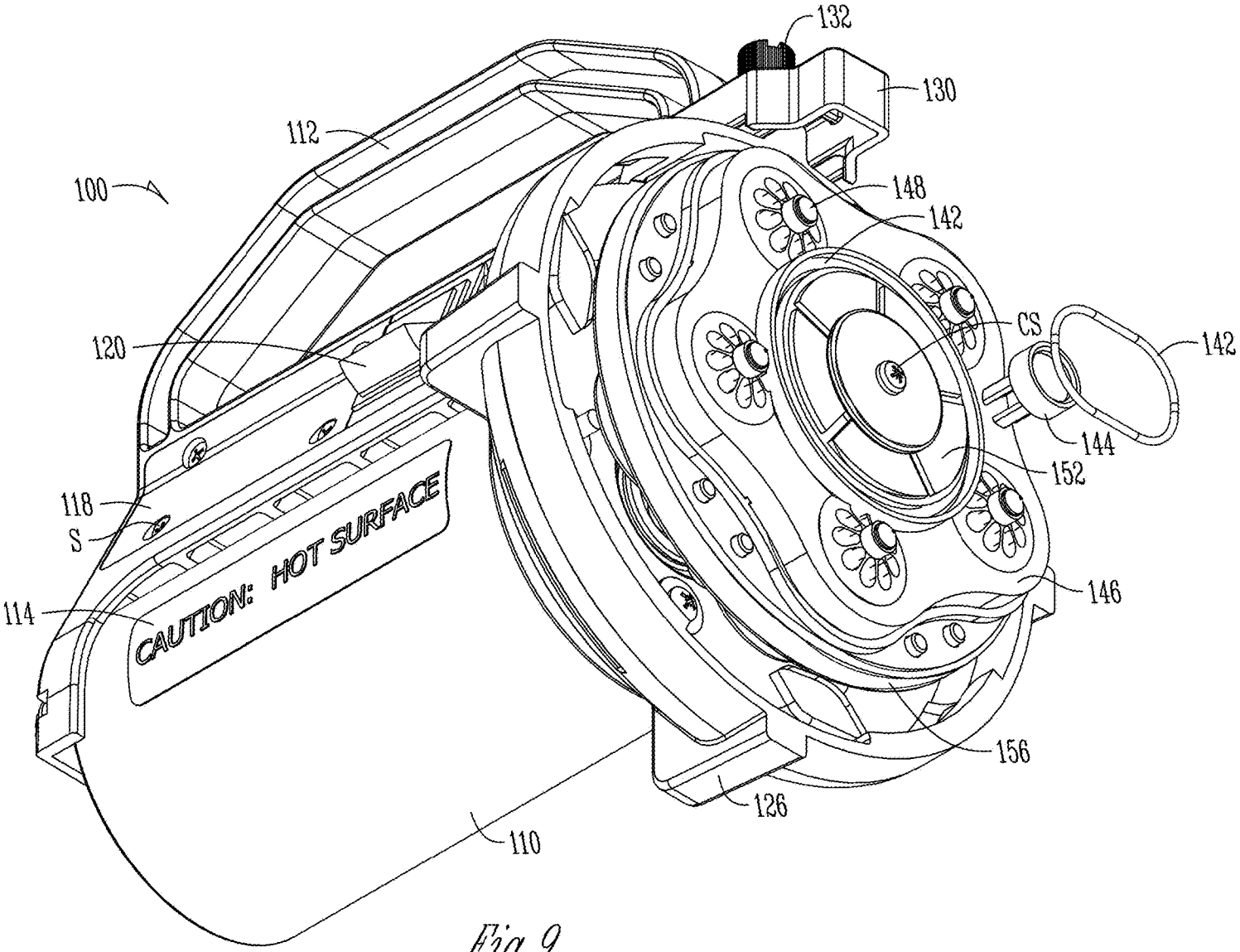
FIG. 9 shows a partially hidden, front perspective view of the self-priming transfer pump of FIG. 8 wherein the main housing portion of the pump section hidden from view, thereby emphasizing view of the relief valve stem, valve plate, and other components related thereto.

An O-ring 142 and relief valve 144 (also called a by-pass valve) are internally positioned within the pump section 102, as shown in FIG. 9. The O-ring 142 is a mechanical gasket in the shape of a torus, i.e., a loop of elastomer with a round cross-section. The O-ring 142 is designed to be seated in a groove behind the relief valve cover 128. The O-ring 142 can be compressed during assembly between two or more parts, creating a seal (preferably hermetic) at the interface. The relief valve 144 controls and/or limits pressure by allowing fluid to flow into an auxiliary passage, away from the main flow path. The relief valve 144 is configured to activate at a predetermined pressure. When the predetermined pressure is exceeded, the relief valve 144 becomes the "path of least resistance" and the relief valve 144 is forced to open. When open, a portion of the fluid is diverted through the auxiliary route. There exist some embodiments where the diverted fluid can be returned back to either the reservoir or the pump inlet 106. The relief valve 144 can act as a safety precaution, i.e., the relief valve 144 sets a limit for the maximum operating pressure of the pump 100, ready to operate should the pump 100 exceed the predetermined pressure. The relief valve 144 and bypass path can be an integral part of the pump 100 or separately installed as a component in the fluid path.

The valve plate 146 includes valves 148, the pistons of which protrude through openings of the same. The shape of the openings corresponds with the pistons so as to create an interference fit. For example, the shape of the openings can comprise almost any known two-dimensional shape but are preferably ovals (selected from ellipses, circles, etc.). The valves 148 can be flexible discs secured within a valve seat by interference fit, wherein each valve 148 has a headed extension and a central aperture in a corresponding valve seat.

Figure 10:
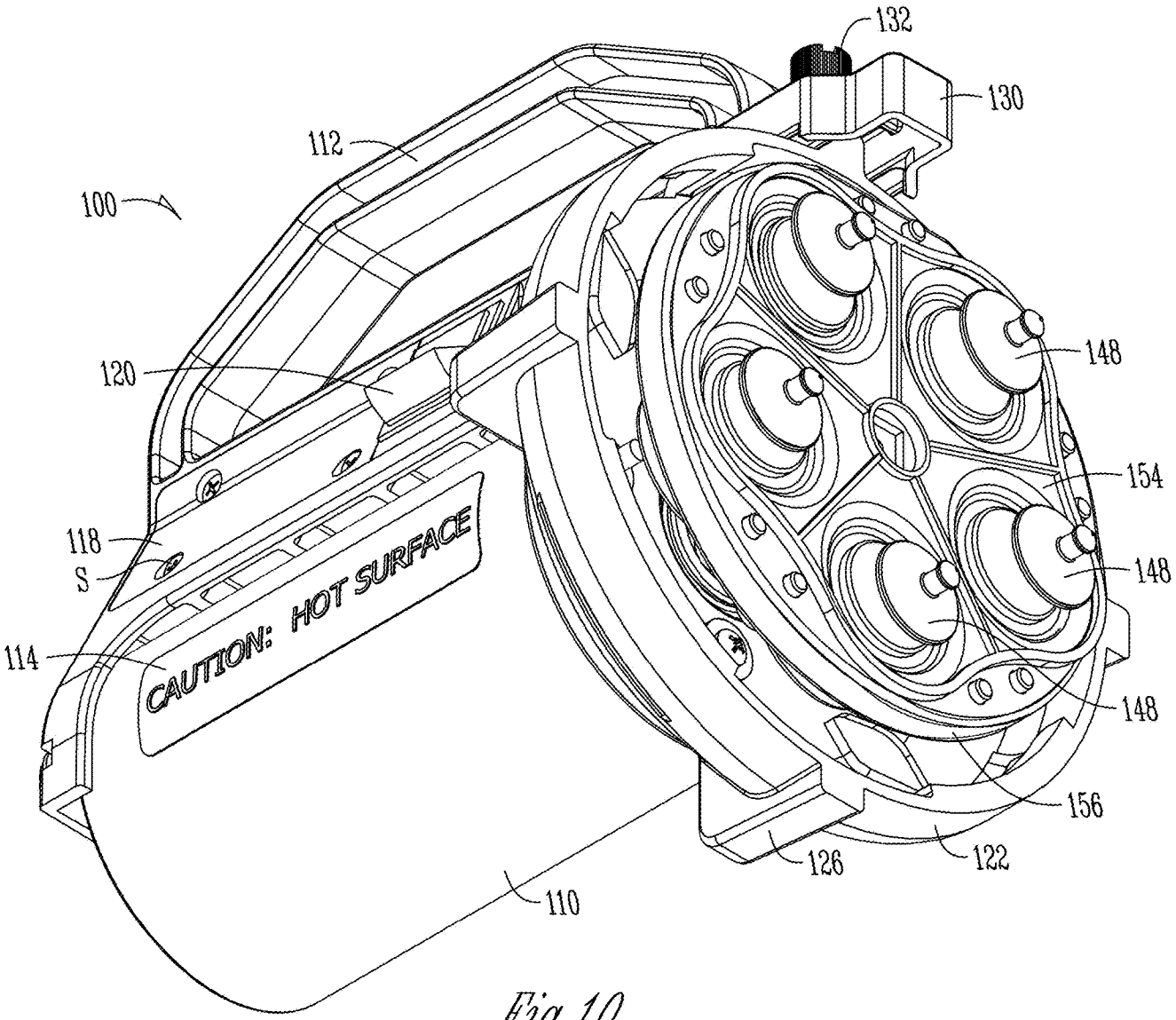
FIG. 10 shows a partially hidden, front perspective view of the self-priming transfer pump of FIG. 9 wherein the valve plate is further hidden from view, thereby emphasizing view of the valve plate and other components related thereto.
Figure 11:
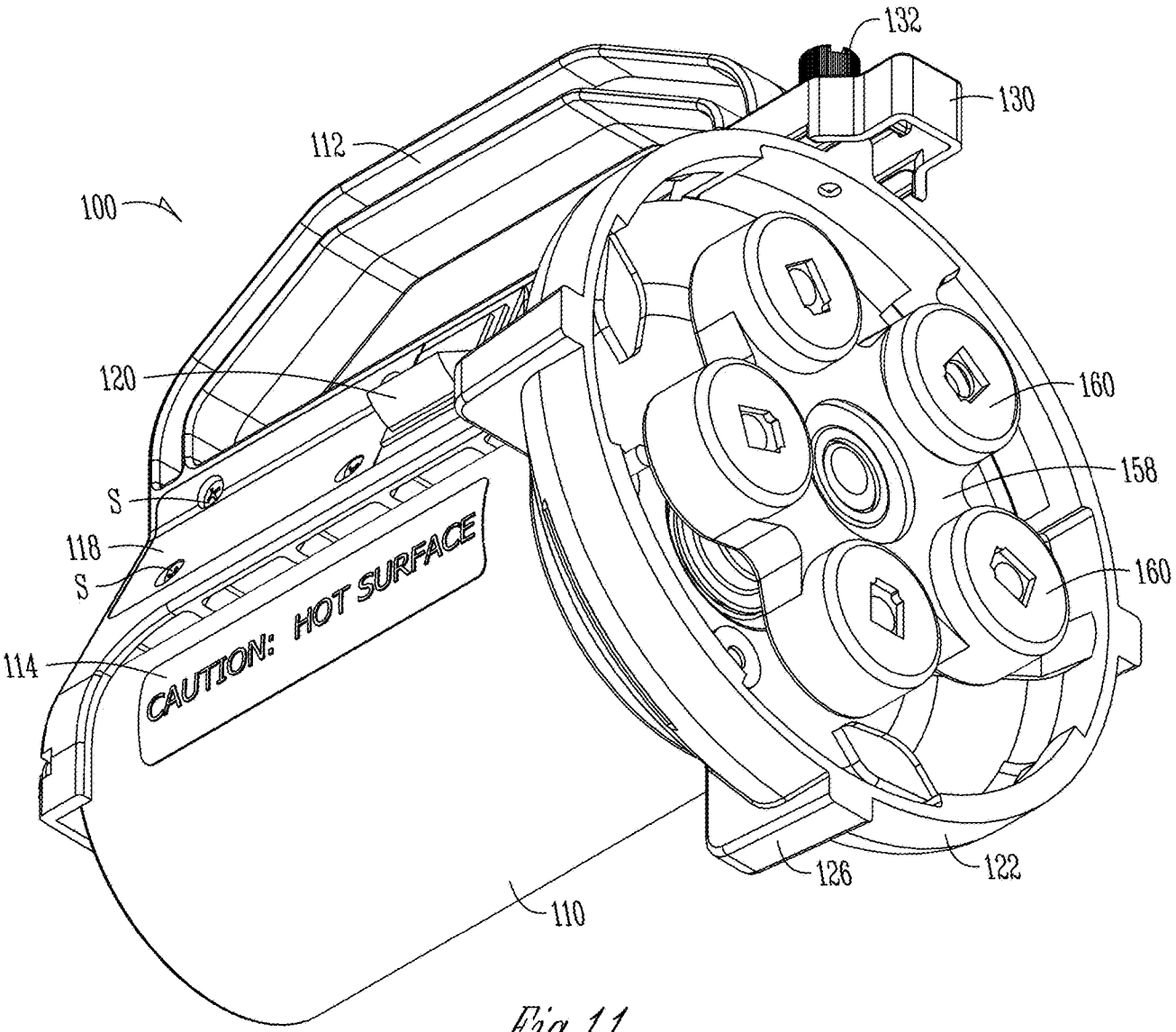
FIG. 11 shows a partially hidden, front perspective view of the self-priming transfer pump of FIG. 10 with the diaphragm is further hidden from view, thereby emphasizing view of the wobble plate and other components related thereto.

A central screw CS, washer support 150, and rubber washer 152, and another O-ring 142 further secure the valve plate 146 in position during operation. The valves 148 can be shown in greater detail in FIG. 10. Also shown in FIG. 10 are the diaphragm 154 and clamp plate 156 that secure the diaphragm into position during operation of the pump 100. FIG. 11 shows the wobble plate 158 and a number of rocker arms 160 corresponding to the number of chambers in the pump 100. This O-ring 142 can be positioned between the rubber washer 150 and the valve plate 146.

The pistons of the diaphragm 154 can be coupled to the wobble plate 158 so that the pistons are actuated by movement of the wobble plate 158. Rocker arms 160 engage the pistons in a reciprocating rotational manner, thereby transmitting force from the center of the wobble plate 158 to locations adjacent to the pistons. The material of the diaphragm 154 can be a thermoplastic elastomer. The diaphragm 154 may warp or deform less over time if the pistons are constructed of a material that is more rigid than the material of the diaphragm 154 and/or clamp plate 156.

Figure 12:
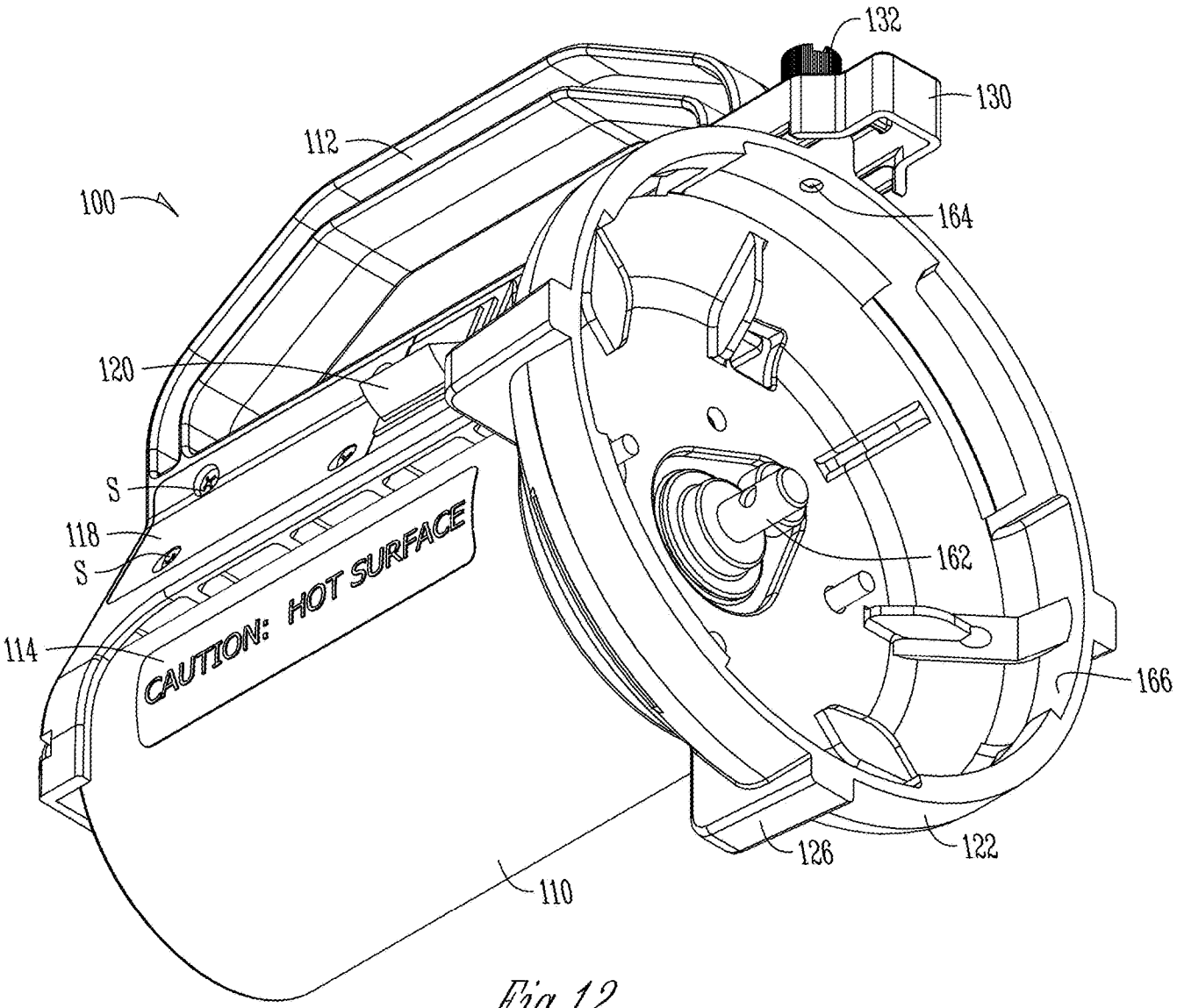
FIG. 12 shows a partially hidden, front perspective view of the self-priming transfer pump of FIG. 11 wherein the wobble plate is further hidden from view, thereby emphasizing view of the motor mounting plate and other components related thereto.
Figure 13A:
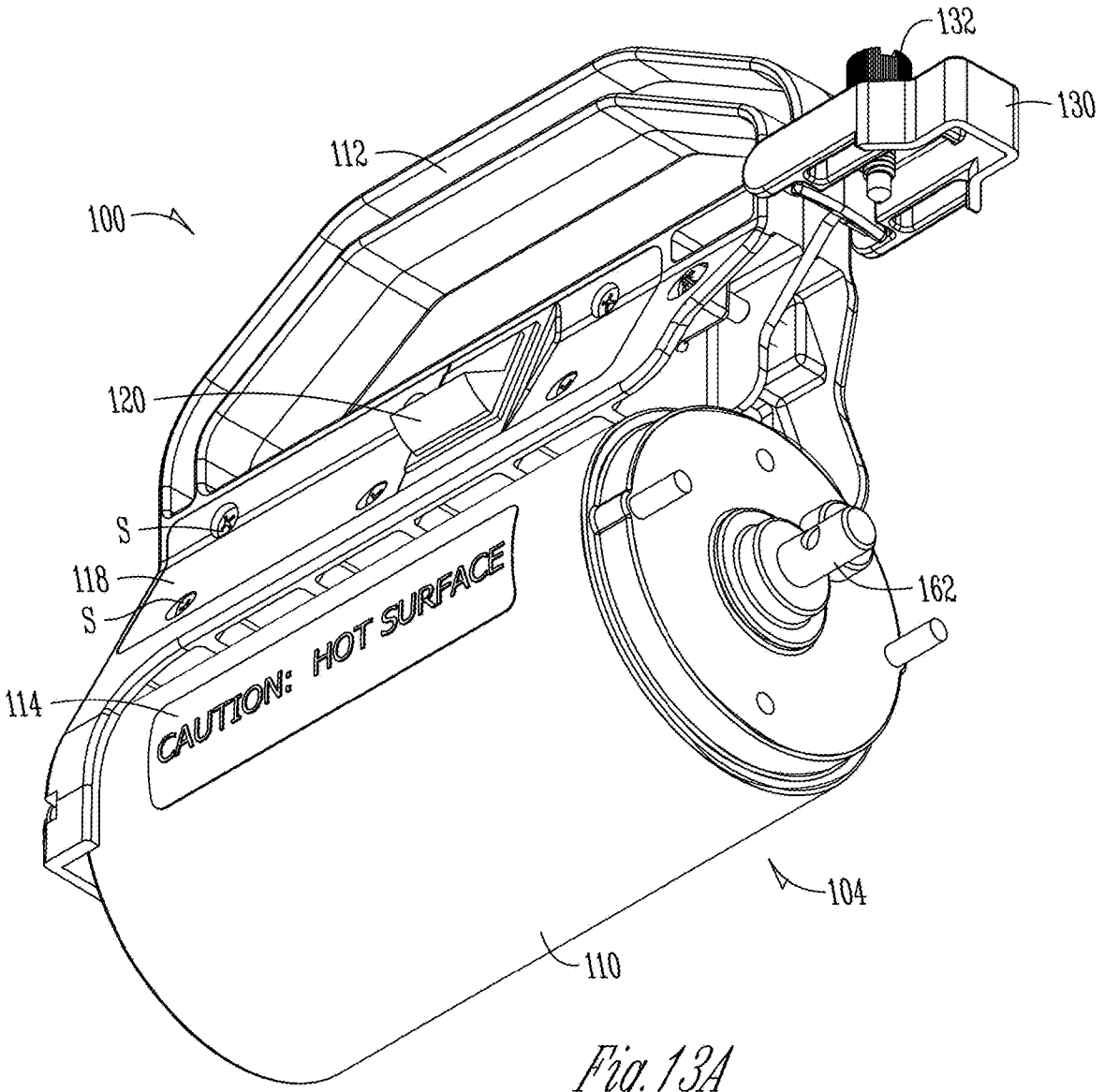
FIG. 13A shows a partially hidden, front perspective view of the self-priming transfer pump of FIG. 12 wherein the motor mounting plate is further hidden from view, thereby emphasizing view of the pump motor and other component(s) related thereto.
Figure 13B:
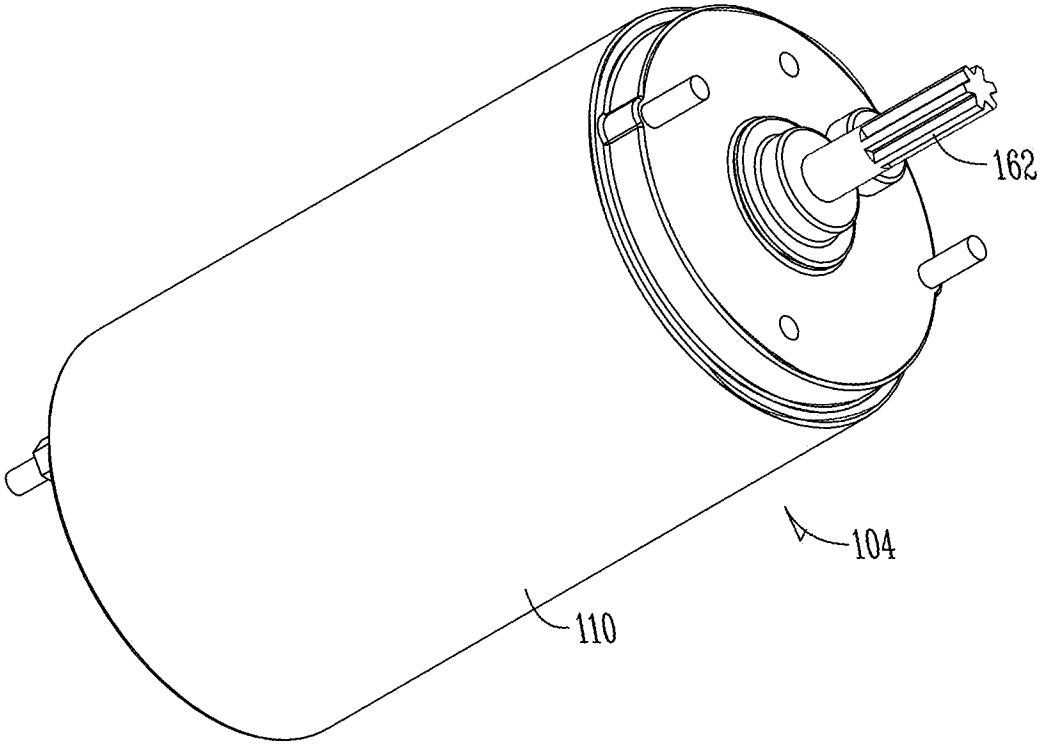
FIG. 13B shows a perspective view of a motor of the self-priming transfer pump of FIG. 13A wherein a male spline is included directly on the motor shaft.

FIGS. 12, 13A and 13B show in greater detail aspects of the central motor shaft 162 not viewable in most other figures. FIG. 12 also shows in detail some internal aspects of the unique motor mounting plate 122. The motor mounting plate 122 includes an upper aperture 164, preferably female threaded, capable of receiving the head screw 132 of the locking mechanism 130. The notches 166 of the motor mounting plate 122 are meant to correspond with protrusions 168 located on the housing of the pump section 102, which are shown in FIG. 14. The pump section 102 can thus be said to have integrally built therein a "pump mounting plate", similar to the motor mounting plate except in that the pump mounting plate cannot be separated from the rest of the pump section 102. Though it is to be appreciated there will exist some embodiments (not shown) wherein the "pump mounting plate" can be an entirely separate component from the rest of the pump housing of the pump section 102.

The protrusions 168 shown in the figures include a ramp 168A at one end and a tooth 168B at the other. After the pump section 102 is initially aligned with the motor section 104 and pushed together, the pump section 102 can be rotated at an angle corresponding with the structure of the protrusions 168 and the notches 166 such that the edges of the motor mounting plate 122 are forced upward via the ramp 168A until they pass the tooth 168B at the other end and "drop" into the operable position. A radial distance from the center of the pump section 102 to the outermost portion of the protrusions 168 can, for example, be approximately 2.98 inches, wherein "approximately", in the context of a radial distance being specified to two decimal points, means said distance can be within a tolerance of ±0.005 inches. When dropping into the operable position, a taper can be employed in the notches 166 so that a strong, fiction/interference fit is established, thereby initially locking the pump section 102 into position with respect to the motor section 104. The taper can, for example, comprise a taper substantially between one and two degrees (1.0°-2.0°).

Other suitable systems of toolless connections can be used in addition or lieu of the protrusions 168 and notches 166. For example, toolless connection mechanisms can comprise, threads, clamp(s), bracket(s), ties, buckles, straps, springs and other resilient members, and the like. Suction forces can also be established between the pump section 102 and motor section 104 to facilitate the toolless connection, such as those caused by magnetic, pneumatic, and/or compressive forces. In such embodiments, the suction side may be designed to be larger than the discharge side so as to increase pressure and avoid starving the pump 100 of fluid.

In essence, the assembly is shown in FIG. 14, with the exception of the handle 112 and its related components, which are provided to give the viewer perspective of the components on the page, though the handle could theoretically be provided in a kit alongside said pump section 102.

In greater particularity, and as is shown in FIG. 14, the wobble plate 158 can be secured to the diaphragm 154 with several fasteners, such as screws S. Each screw S can be positioned radially inwardly from a center of a location of each piston. In some other embodiments, the screws S can even be positioned so as to protrude through central locations of each rocker arm 160.

FIG. 13B shows a male spline made directly into the motor shaft 162. The male spline can be lined up with the corresponding female splined mating section 170 shown in FIG. 14 and pressed into a bearing to run the pump. The use of the splined shaft provides greater control and torque with the motor, which could then be passed to the pump.

As shown in FIG. 15, diaphragm 154 includes ridges 172 or curves corresponding to each one of valves 148. The ridges 172 can help contain and contain pistons of the diaphragm 154 to the clamp plate 156. The ridges 172 can be on both sides of the diaphragm 154 and allow the pistons of the valves 148 to move reciprocally without placing damaging stress upon the diaphragm 154. In some embodiments, the ridges 31 are curved, angled, and/or otherwise configuration so as to improve the compression ratio of the pump, decrease air entrapment, and improve priming capability. This helps the pump 100 be more efficient overall, but is not required in order for the pump 100 to function. The pistons can be integrally connected to the clamp plate 156 and/or the diaphragm 154, such as that which can be achieved through an overmolding process. Overmolding can also help establish hermetic seals. Again, most if not all of the guts 140 can be provided as a single cartridge permanently fixed to the pump section 102. In this way, these components can be inventoried and/or sold as a single part. This also makes assembly of the pump section 102 to the motor section 104 easier.

Because the components of the motor section 104 are intended to be more permanent and are not as easily replaced as the components of the pump section 102, components on the pump section 102 are designed to fail before components on the motor section 104. For example, the motor section housing can be formed from a die cast plate having more than ten times the tensile strength of components on the pump side formed of some types of plastic.

As shown in FIG. 16, the fluid chambers 174 are located on the opposite side of the valve plate 146. It is preferred that no metallic components be allowed to exist inside chambers 174 so as to mitigate risk of corrosion occurring. The fluid chambers 174 through which fluid flows are created on the rear side of the diaphragm 154. The fluid chambers 174 are created between the diaphragm 154 and the valve plate 146. The fluid chambers 174 are separated from one another by fluid chamber walls extending radially away from a central location of the valve plate 146. The valve plate 146 mates with the diaphragm 154 in order to create hermetically sealed fluid chambers 174. The diaphragm 154 can be positioned into a sealing relationship with the valve plate 146 via an outer peripheral wall. The valves 148 include adjacent thereto inlet and outlet apertures which permit fluid flow in the desired directions. Fluid can enter each fluid chamber 174 through the inlet apertures and can exit each fluid chamber 174 through the outlet apertures. The diaphragm 154 actuates fluid in the pump through the inlet apertures and the outlet apertures. When the pistons are actuated by the wobble plate 158, the pistons can move within the fluid chambers 174 with back and forth motion. As the pistons move away from the inlet valves, fluid is sequentially drawn into each fluid chambers 174 through the inlet apertures. As the pistons move toward the inlet valves, fluid is pushed out of the fluid chambers 174 through the outlet apertures.

Figure 17:
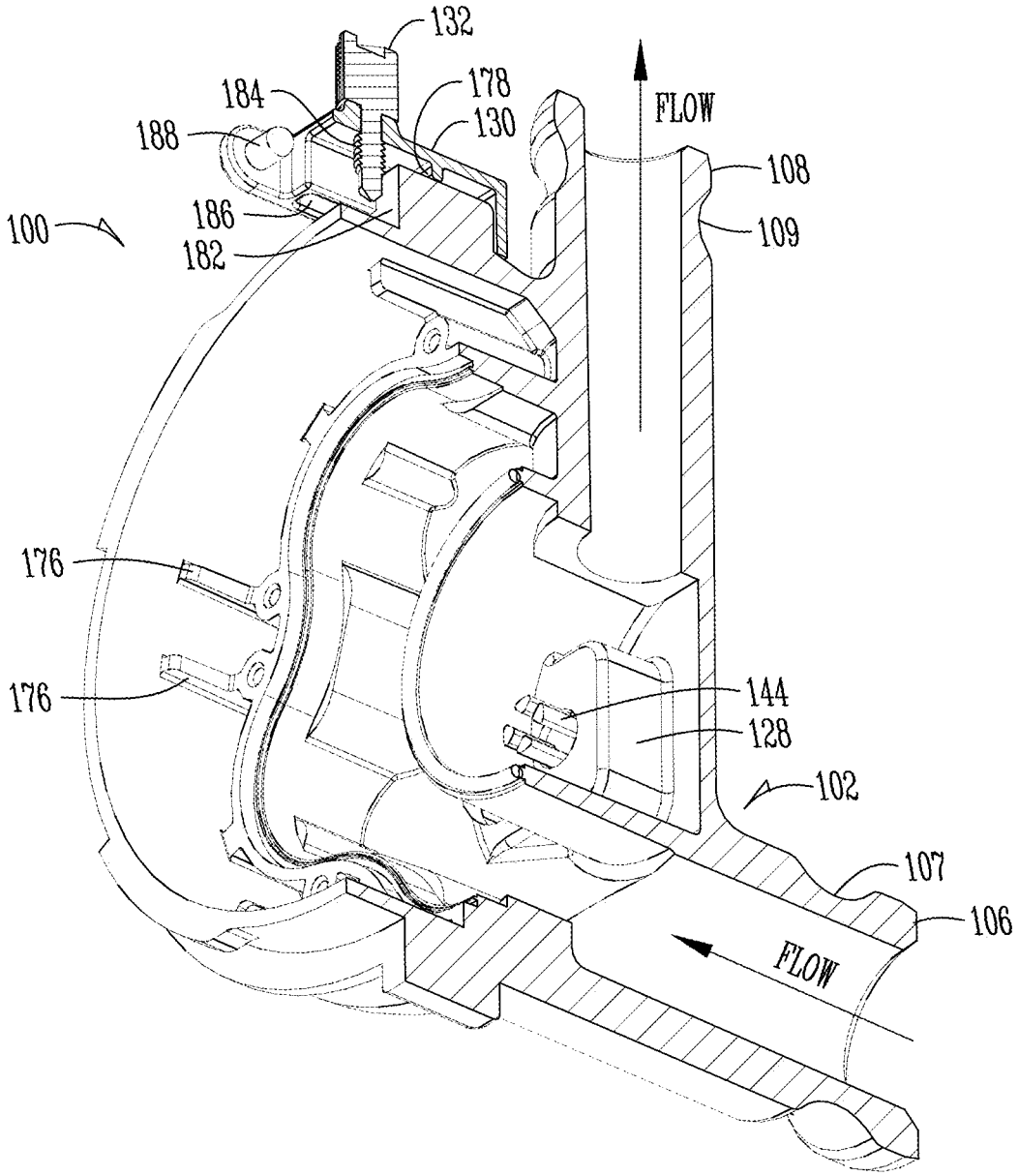
FIG. 17 shows a sectional, rear perspective view of the main housing portion of the pump section, thereby emphasizing view of fluid paths through the inlet and outlet and mechanical connection(s) to the external locking mechanism, also shown.
Figure 18:
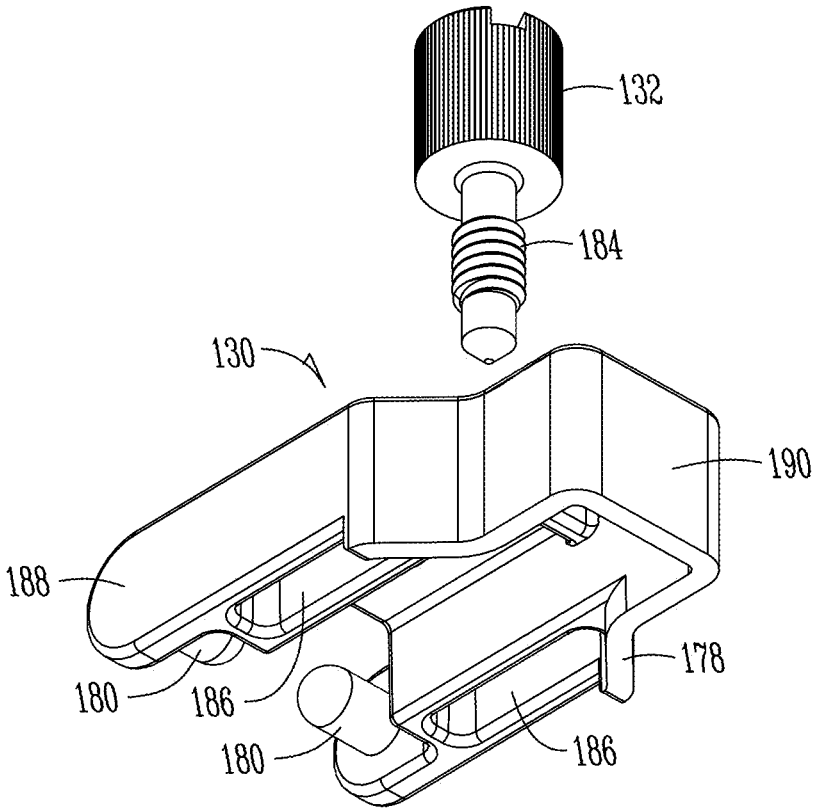
FIG. 18 shows a detailed view of the external locking mechanism.
Figure 19A:
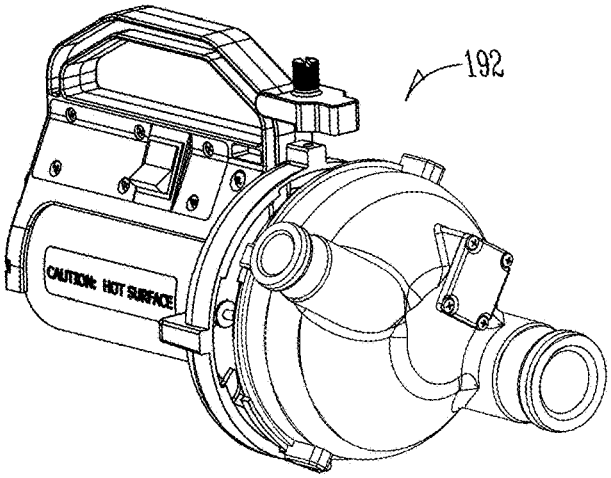
FIGS. 19A-C and FIG. 20 show stepped views of a method for attaching/detaching the main housing portion of the pump section to the motor section.
Figure 19B:
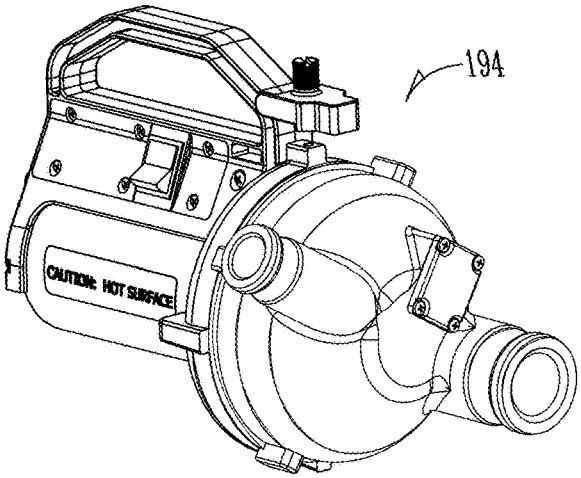
Figure 19C:
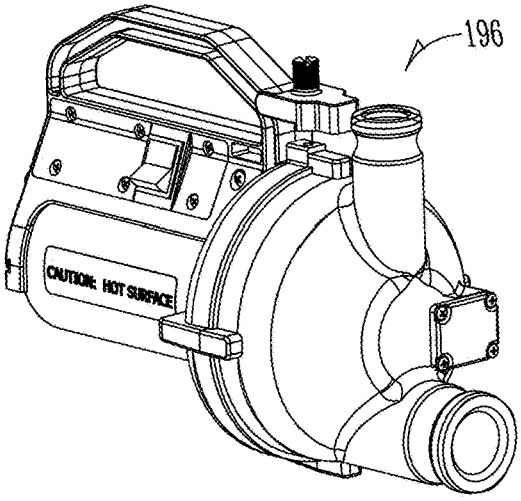
Figure 20:
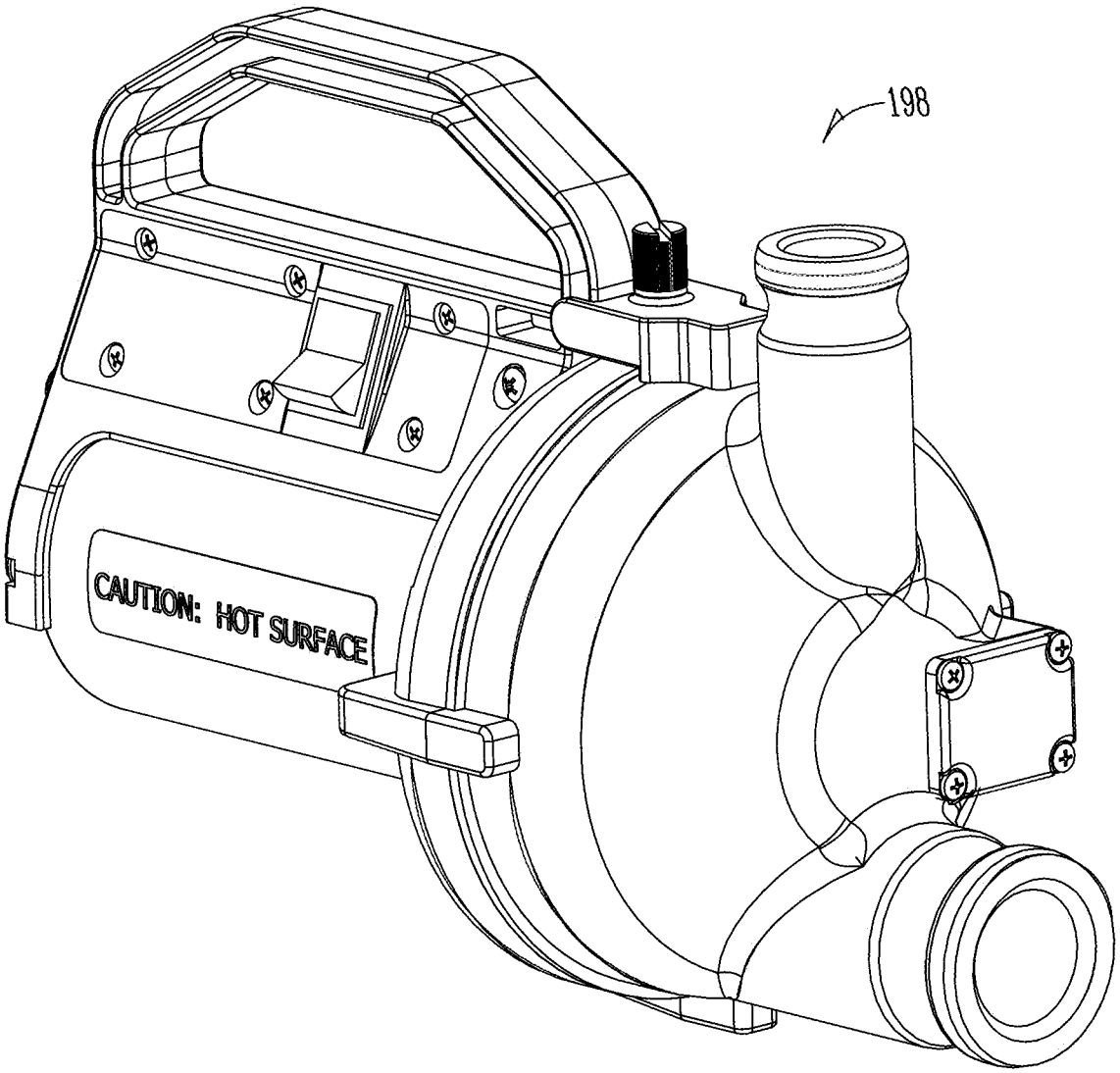
Figure 21:
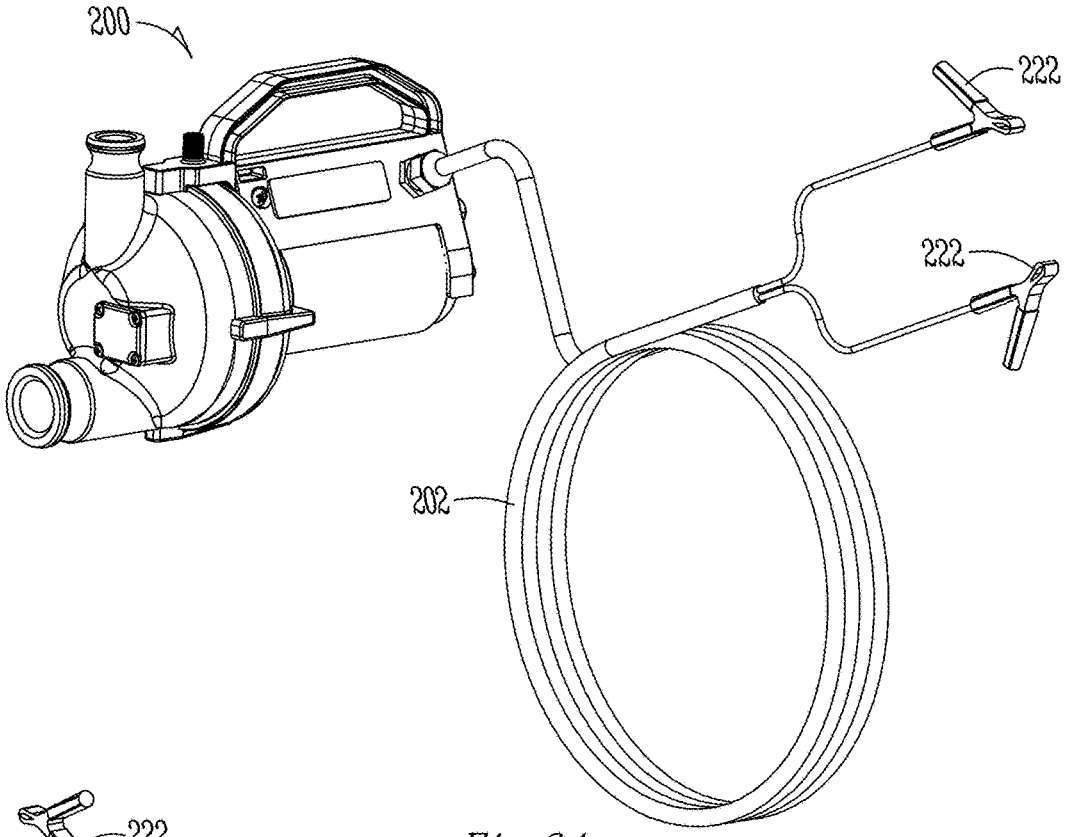
FIG. 21 shows a perspective view of another embodiment of a self-priming transfer pump with quick pump attachment/detachment with battery clamps and as means for providing power, according to some aspects of the invention.
Figure 22:
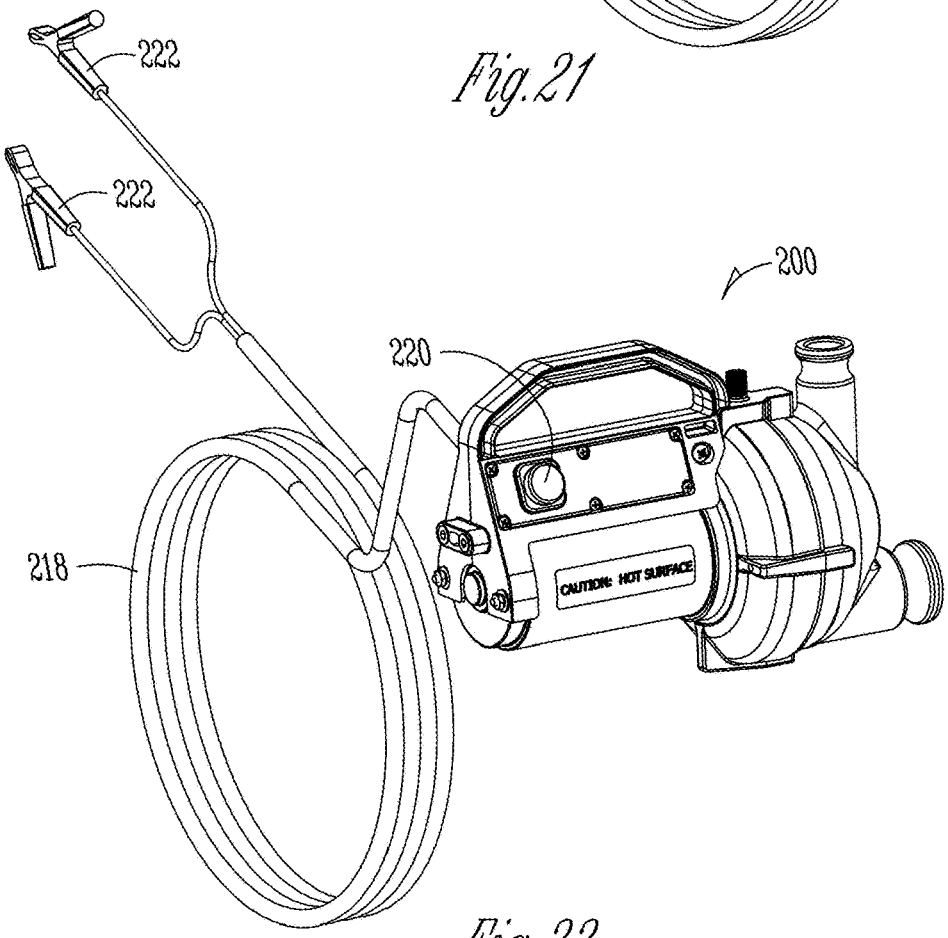
FIG. 22 shows another perspective view the self-priming pump of FIG. 21, emphasizing view of the push button switch that can be employed in lieu of a rocker switch.
Figure 23:
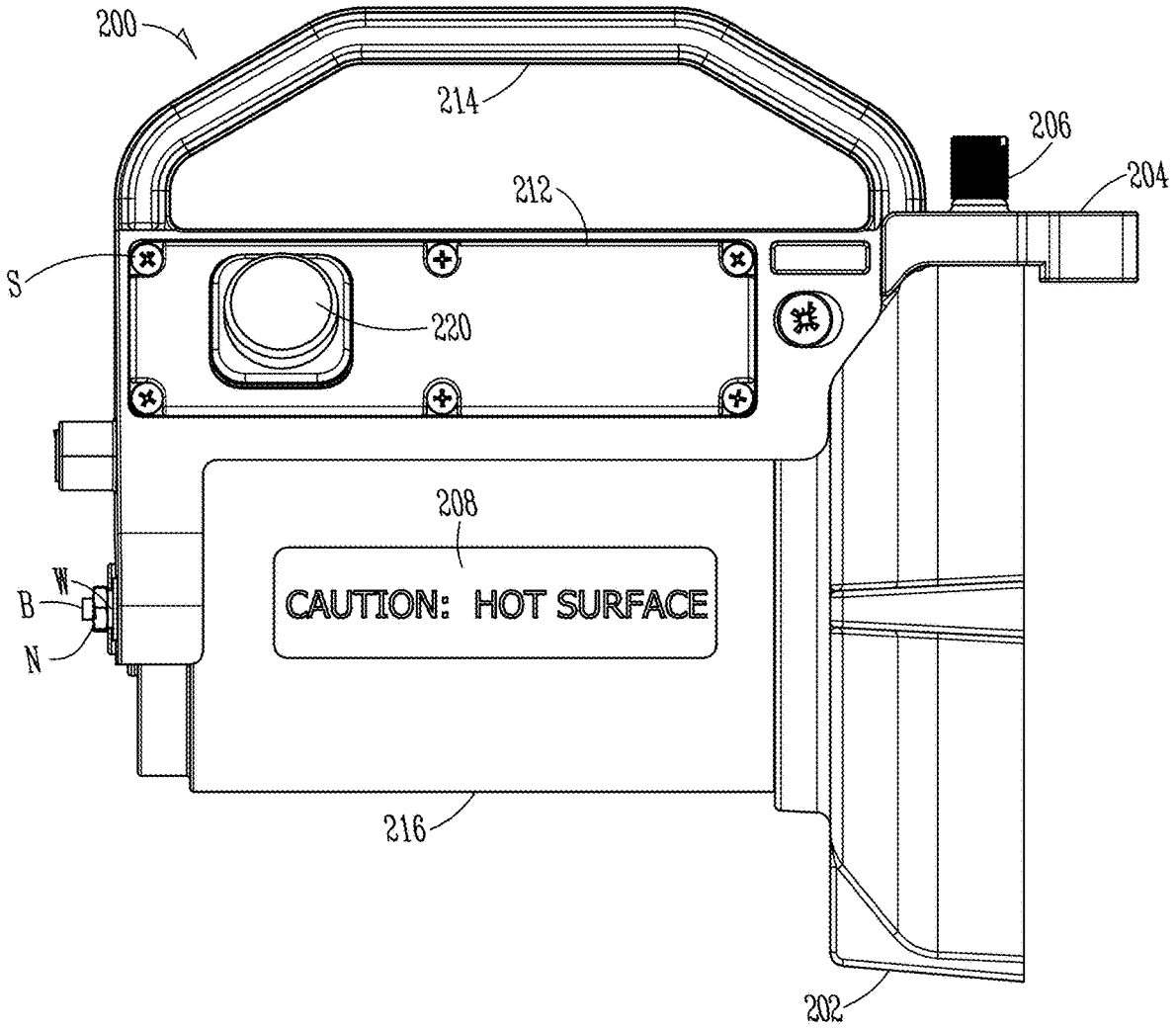
FIG. 23 shows a front elevation view of the self-priming pump of FIG. 21.

Assembly of the pump is facilitated by the many components of the improved pump section 102 and the improved locking mechanism 130 that are shown in FIGS. 17-18. Such components include the ribs 176 of the pump section 102, an internal flange 178 (also known as a locking tab) positioned near a body 190 of the external locking mechanism 130, legs 188 extending from the body 190, slots 186 in legs 188 and/or body 190, oppositely oriented pegs 180 extending inwardly from the legs 188, a bulge 182 that extends perpendicularly away from an external peripheral surface of the pump housing, said bulge 182 being adapted to engage the locking tab 178, and a helical plane 184 that exists on a shaft of the head screw 132.

With regard to FIGS. 19A-C and FIG. 20, to assemble the pump section 102 and motor section 104 to form the pump 100, an aligning step 192 can be performed such that the protrusions 168 (also known as raised surfaces) match notches 166 in the motor section 104 and, via sliding step 194, are slid into place. The pump section 102 is then rotated an eighth-turn (45°), quarter-turn (90°), half-turn (180°), and/or any other suitable-type turn, via rotating step 196, until the pump section 102 locks into place. To further lock and stabilize the pump section 102, a locking step 198 can be performed such that the locking mechanism 130 slides down to engage the pump section 102 to ensure the housing of same does not vibrate loose.

Before operation of the pump 100, hoses and fittings should be tightly connected, the rocker switch 120 should be turned off before making the electrical connection via the snap in cord grip 134.

FIGS. 21-29 show another embodiment of the pump 200, with most components being similar to those components of the pump 100 of FIGS. 1-20.

For example, the pump 200 similarly includes a motor mounting plate 202, a pump lock 204, a panel screw 206, a bolt B, nut N, and washer W, a caution label 208, and a source/manufacturer identifier 210.

Also shown in FIGS. 21-29 is handle cover 212 (which can attach to the motor section via a handle cover gasket), handle 214, and motor 216.

For motors 216 that are a 12V version, battery clips 222 are preferably secured to the power source (battery or power supply) via wires 218. While the rocker switch 120 can still be employed in such an embodiment, a push button switch 220 is shown to be included in lieu of the rocker switch 120 as a reasonable equivalent for providing the operator with means to turn the pump on and off.

Figure 24:
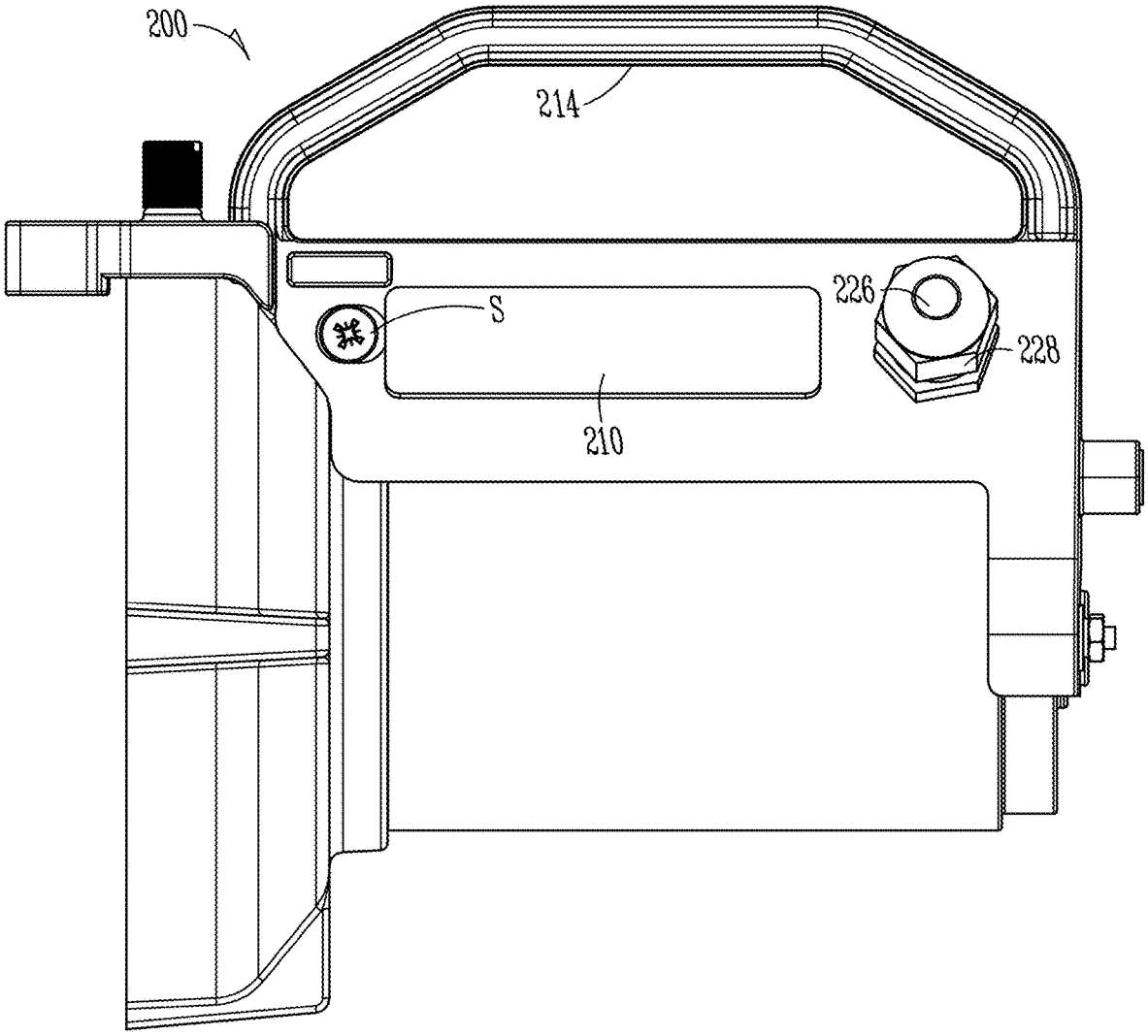
FIG. 24 shows a rear elevation view of the self-priming pump of FIG. 21.
Figure 25:
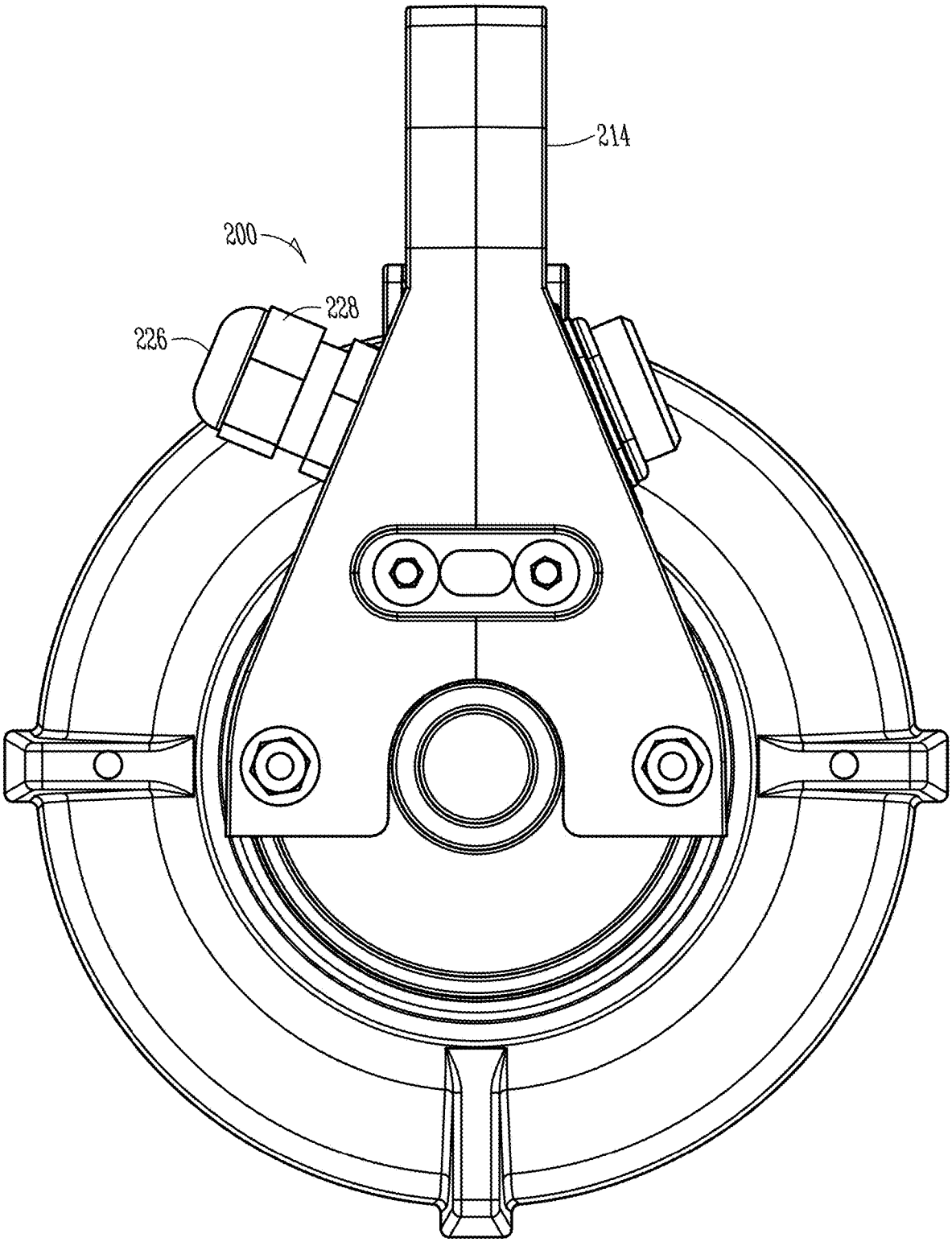
FIG. 25 shows an external end view of the motor section of the self-priming pump of FIG. 21.
Figure 26:
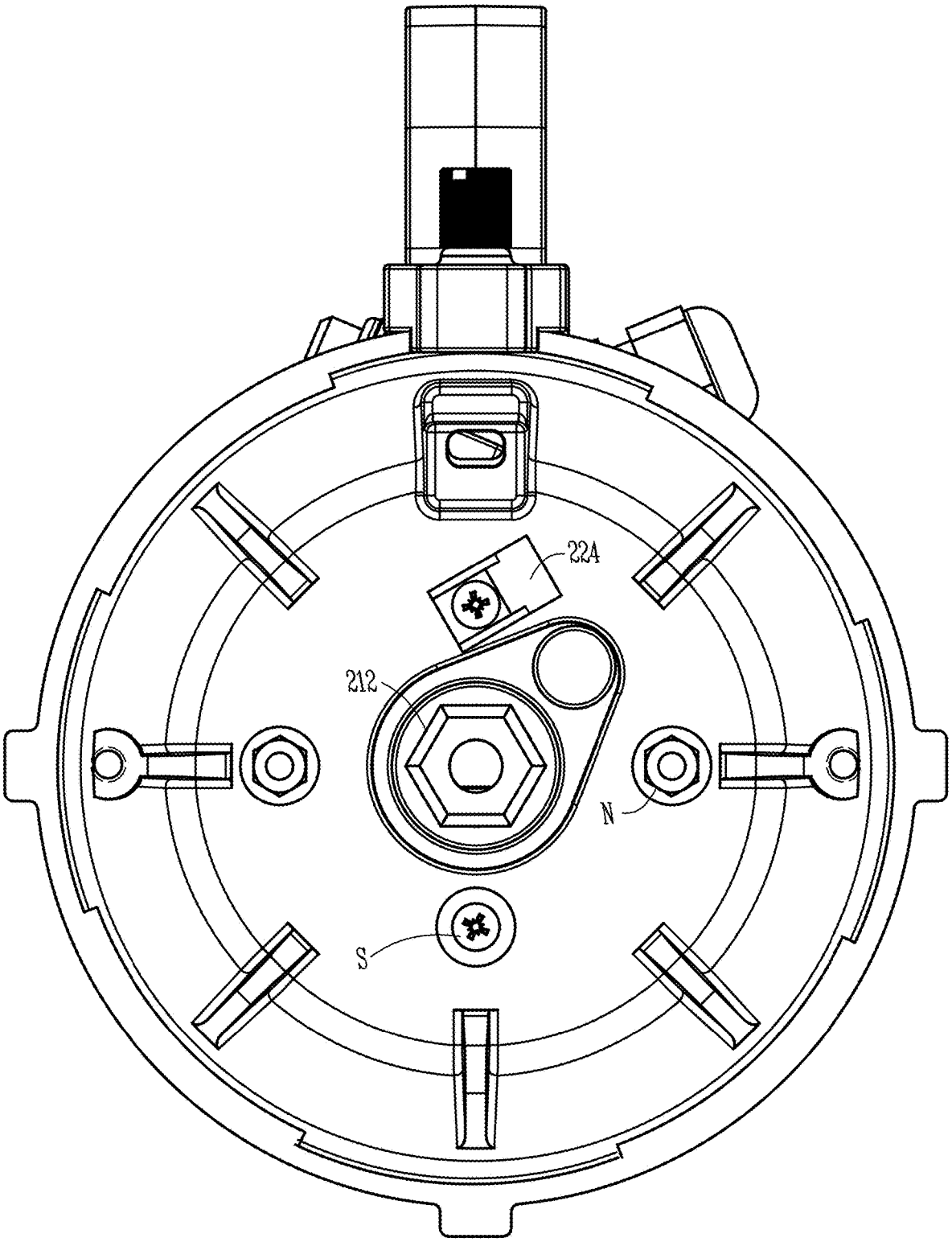
FIG. 26 shows an internal end view of the motor section of the self-priming pump of FIG. 21.

FIGS. 24-25 emphasize view of cable connector 226 and nylon nut 228, while FIG. 26 emphasizes view of routing clamp 224.

Figure 27:
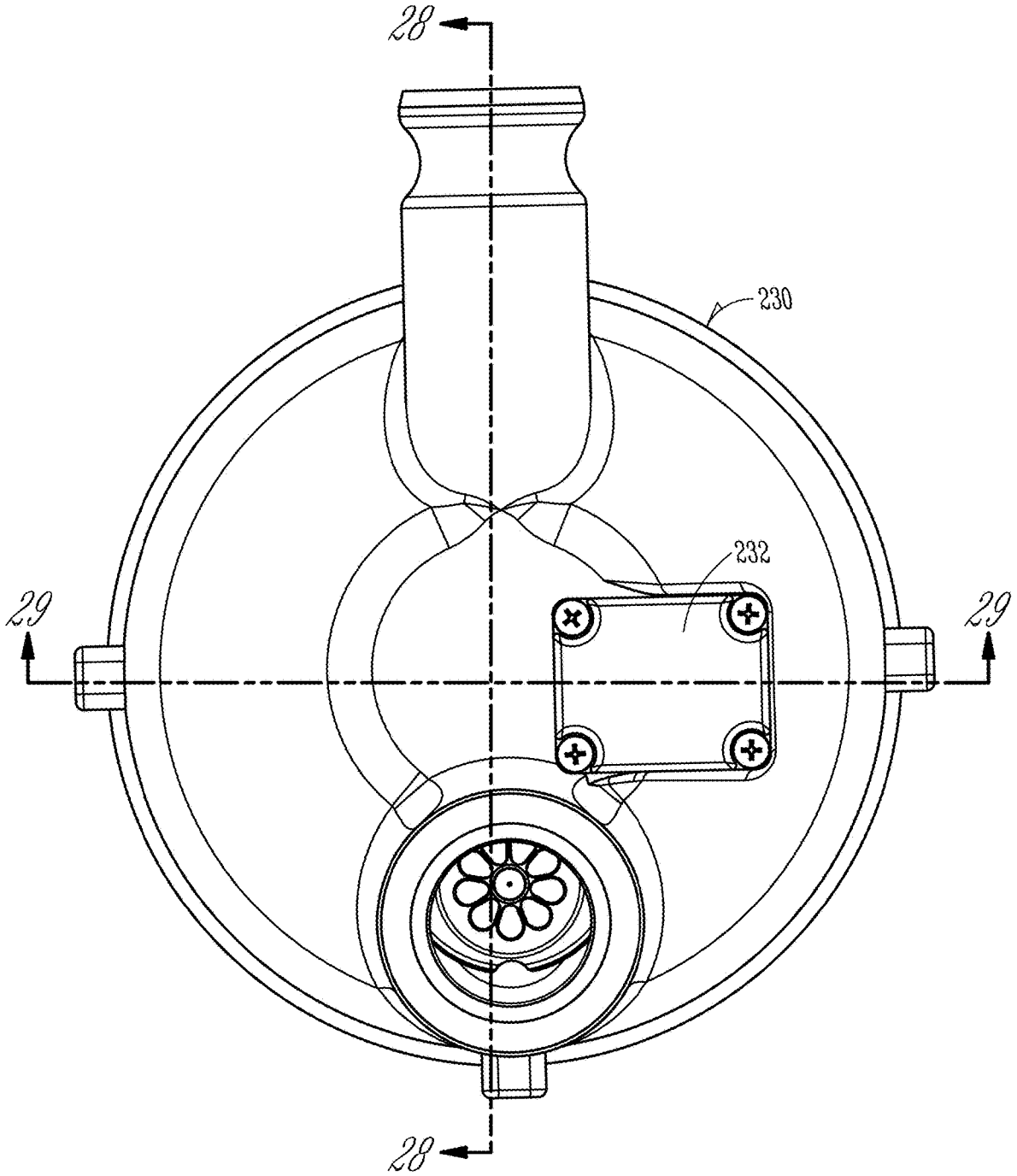
FIG. 27 shows an external end view of the pump section of the self-priming pump of FIG. 21.
Figure 28:
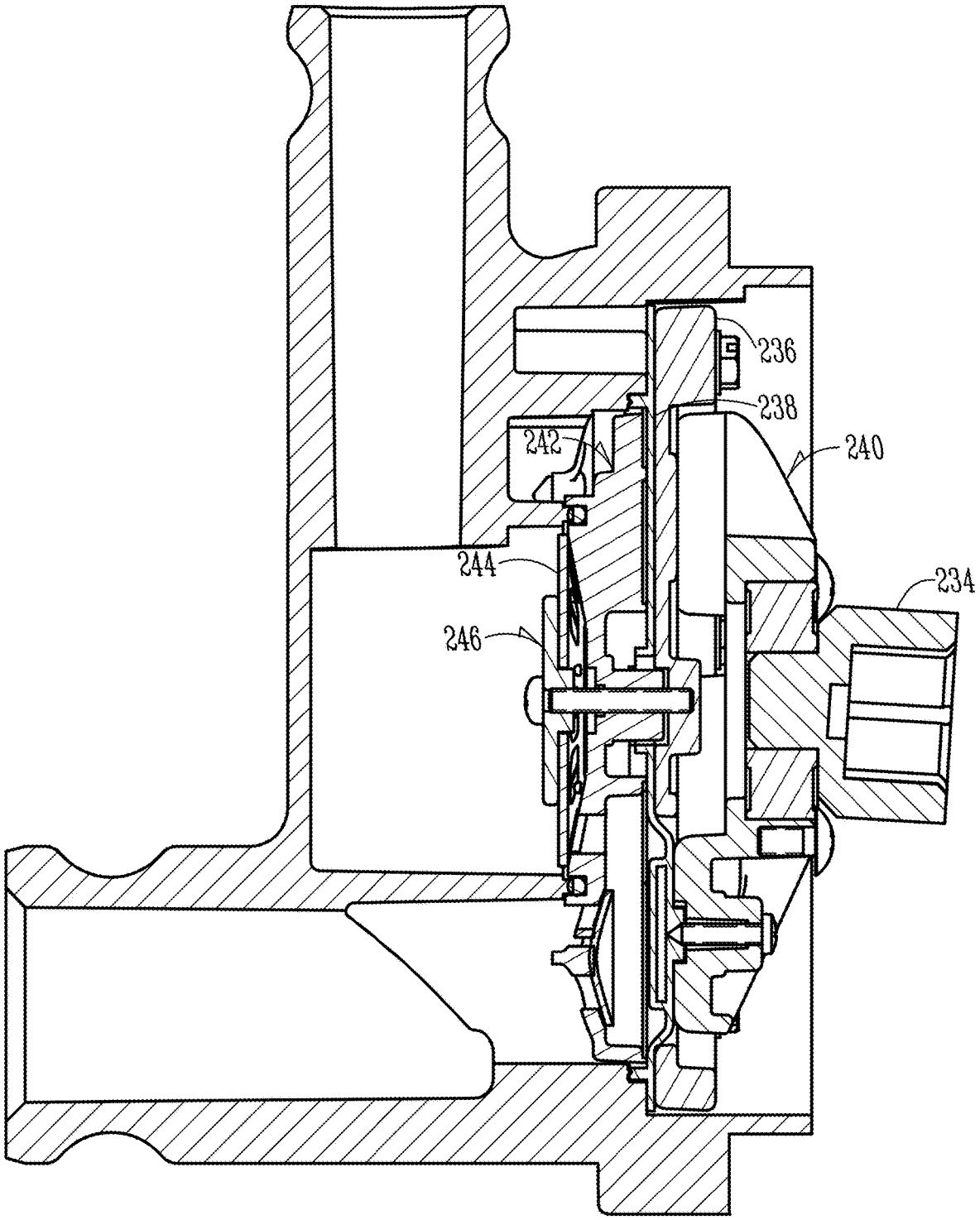
FIG. 28 shows a sectional view of the pump section along line 28-28 in FIG. 27.
Figure 29:
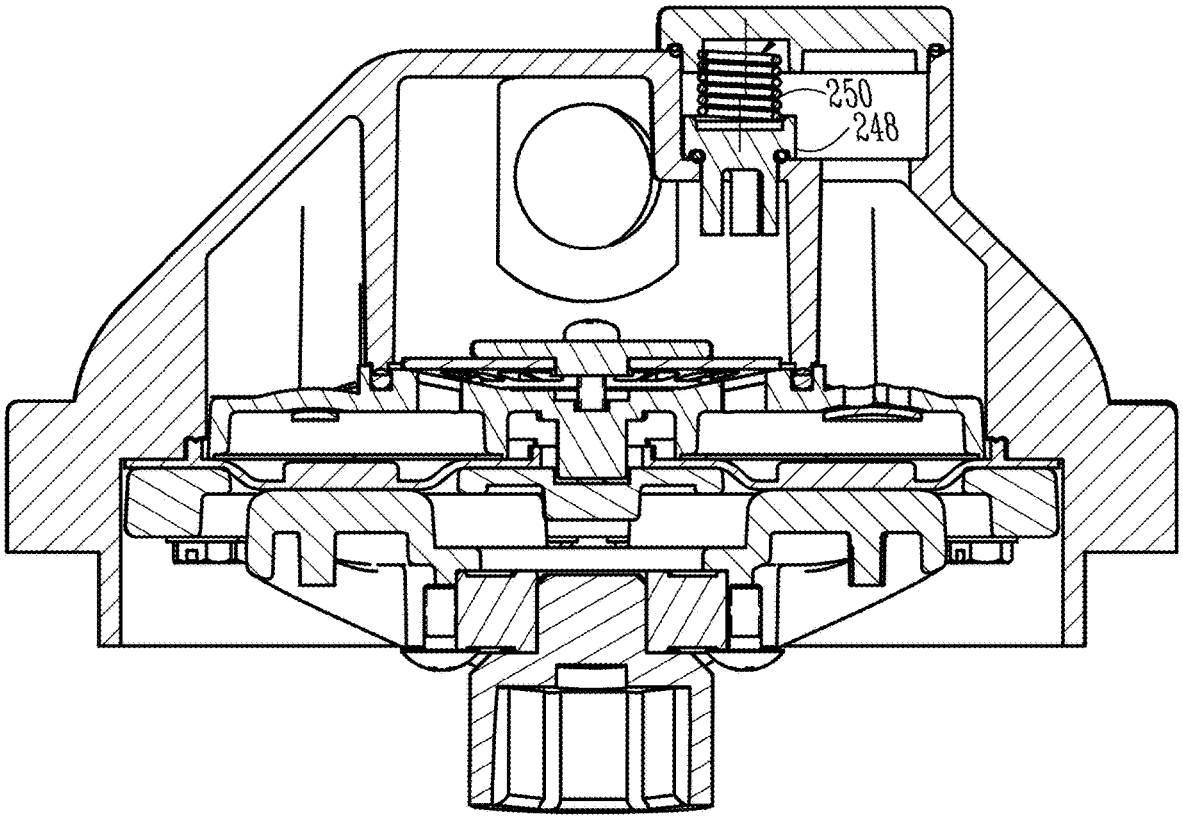
FIG. 29 shows a sectional view of the pump section along line 29-29 in FIG. 27.

FIGS. 27-29 show aspects of the pump section of pump 200. The pump section includes main pump housing 230 and relief valve cover 232 are shown in FIG. 27. The wobble plate coupling 234, valve clamp plate 236, pump diaphragm 238, wobble plate assembly 240, bypass valve assembly 242, discharge diaphragm 244, and gland assembly 246 are shown in FIG. 28. The relief valve stem 248 and relief valve spring 250 are shown in FIG. 29.

Figure 30:
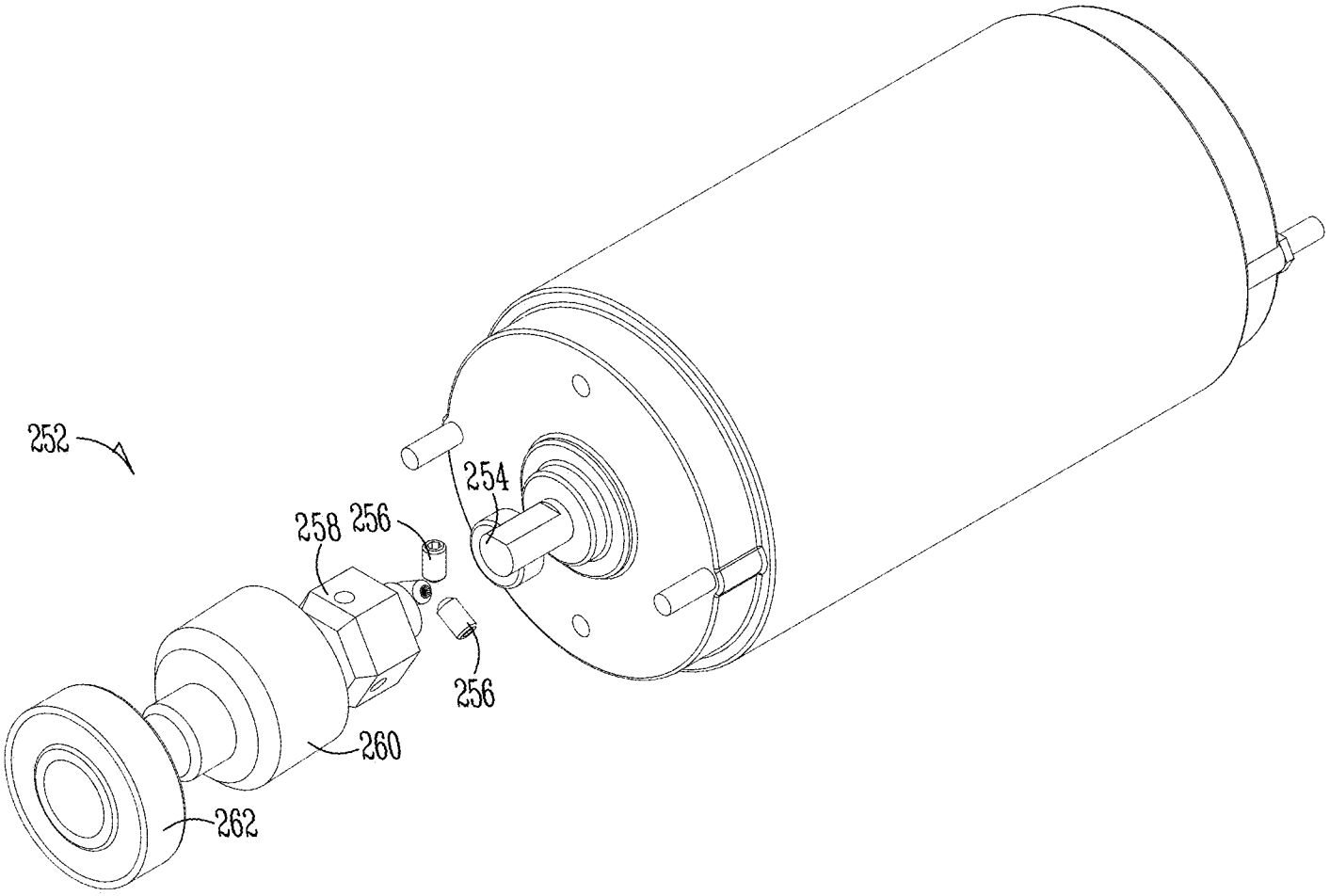
FIG. 30 shows an exploded view of a motor assembly that includes a hex shaped motor drive.

As shown in FIG. 30, the pump 200 differs from pump 100 in that it includes a motor hex drive assembly 252. The motor hex drive assembly 252 is an alternative means for connecting the motor section 202 to the pump section 220 of FIGS. 27-29, without requiring the male and female splines of FIGS. 13B and 14. In some embodiments the motor hex drive assembly 252 includes a hex shaped shaft 254, symmetrically arrayed (preferably three) set screws 256 extending from the hex shaped shaft 254 to a hex drive motor 258, a hex drive bearing 260 surrounding the hex drive motor 258, and an annular bearing 262.

It is to be appreciated aspects of the pumps 100, 200 can be used in combination with electronic flow meters known in the art.

From the foregoing, it can be understood that the invention accomplishes at least all of the stated objectives.

Glossary

Unless defined otherwise, all technical and scientific terms used above have the same meaning as commonly understood by one of ordinary skill in the art to which embodiments of the invention pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refer to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The "scope" of the invention is defined by the appended claims, along with the full scope of equivalents to which such claims are entitled. The scope of the invention is further qualified as including any possible modification to any of the aspects and/or embodiments disclosed herein which would result in other embodiments, combinations, subcombinations, or the like that would be obvious to those skilled in the art.

What is claimed is:

1. An interchangeable pump section for use in a self-priming transfer pump, the interchangeable pump section comprising:

a pump housing, comprises:
- an inlet,
- an outlet, and
- a series of notches and protrusions symmetrically arrayed about an internal peripheral surface of the pump housing, each protrusion of said series of protrusions comprising a ramp at one end and a tooth at the other end;

a pump cartridge permanently affixed to the pump housing to eliminate user exposure and need for tools when replacing or changing out the pump cartridge, said pump cartridge comprising therewithin:
- a diaphragm;
- a wobble plate; and
- a valve plate with valves; and an external locking mechanism to prevent the interchangeable pump section from rotating and disengaging from a motor section, wherein the external locking mechanism includes:
- a locking tab and a head screw;
- legs in parallel relation to one another, each of the legs extending away from a body of the external locking mechanism;
- a peg extending inwardly from each of the legs; and
- a slot in each of the legs.

2. The interchangeable pump section of claim 1, further comprising a bulge that extends perpendicularly away from an external peripheral surface of the pump housing, said bulge being adapted to engage the locking tab.

3. The interchangeable pump section of claim 1, further comprising an aperture adapted to receive a helical plane of the head screw.

* * * * *